US010794044B2

(12) United States Patent
Ogawa et al.

(10) Patent No.: US 10,794,044 B2
(45) Date of Patent: Oct. 6, 2020

(54) WORK MACHINE HYDRAULIC CONTROL SYSTEM

(71) Applicant: Hitachi Construction Machinery Co., Ltd., Taito-ku, Tokyo (JP)

(72) Inventors: Yuichi Ogawa, Tsuchiura (JP); Seiji Hijikata, Tsukuba (JP); Masatoshi Hoshino, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 224 days.

(21) Appl. No.: 16/082,748

(22) PCT Filed: Mar. 27, 2017

(86) PCT No.: PCT/JP2017/012474
§ 371 (c)(1),
(2) Date: Sep. 6, 2018

(87) PCT Pub. No.: WO2018/179070
PCT Pub. Date: Oct. 4, 2018

(65) Prior Publication Data

US 2020/0173145 A1 Jun. 4, 2020

(51) Int. Cl.
*E02F 9/22* (2006.01)
*F15B 1/02* (2006.01)
(Continued)

(52) U.S. Cl.
CPC ..... *E02F 9/2296* (2013.01); *E02F 9/2217* (2013.01); *F15B 1/02* (2013.01);
(Continued)

(58) Field of Classification Search
CPC ..... F15B 1/022; F15B 1/024; F15B 11/02; F15B 11/10; F15B 21/14; F15B 2211/355; F15B 2211/36; E02F 9/2217; E02F 9/2285
See application file for complete search history.

(56) References Cited

U.S. PATENT DOCUMENTS 8,713,930 B2 * 5/2014 Cheong ..... E02F 9/2232 60/452
10,273,658 B2 * 4/2019 Hijikata ..... E02F 9/2267
(Continued)

FOREIGN PATENT DOCUMENTS

JP 2-58101 U 4/1990
JP 6-323308 A 11/1994
(Continued)

OTHER PUBLICATIONS

International Search Report (PCT/ISA/210) issued in PCT Application No. PCT/JP2017/012474 dated May 9, 2017 with partial English translation ( four (4) pages).
(Continued)

*Primary Examiner* — Michael Leslie
(74) *Attorney, Agent, or Firm* — Crowell & Moring LLP

(57) ABSTRACT

Provided is a work machine hydraulic control system capable of detecting abnormality in a pump output power switching device independently of the abnormality state of the pump output power switching device. A hydraulic control system of a hydraulic excavator is equipped with an accumulator 21 connected to a hydraulic line 25A between a pilot pump 17 and a pilot valve 20, an unloading valve 27
(Continued)

that is a pump output power switching device, a pressure sensor 29 detecting the pressure of the hydraulic fluid supplied to the pilot valve 20, and a controller 30 having a pump output power control section 31 switching the unloading valve 27 in accordance with the pressure detected by the pressure sensor 29. The controller 30 further has an abnormality determination section 32 that computes a command continuation time in a state in which a command output to the unloading valve 27 is not changed. In the case where this command continuation time is not less than a predetermined value, it determines that the unloading valve 27 is abnormal, and outputs the determination result.

8 Claims, 12 Drawing Sheets

(51) Int. Cl.
*F15B 11/08* (2006.01)
*F15B 21/14* (2006.01)

(52) U.S. Cl.
CPC ..... *F15B 1/024* (2013.01); *E02F 9/2232* (2013.01); *E02F 9/2267* (2013.01); *E02F 9/2285* (2013.01); *F15B 11/08* (2013.01); *F15B 21/14* (2013.01); *F15B 2211/20546* (2013.01); *F15B 2211/355* (2013.01); *F15B 2211/36* (2013.01); *F15B 2211/6309* (2013.01); *F15B 2211/6316* (2013.01); *F15B 2211/6355* (2013.01)

(56) References Cited

U.S. PATENT DOCUMENTS

| | | | | |
|---|---|---|---|---|
| 10,648,156 | B2 * | 5/2020 | Fukuda | E02F 9/22 |
| 2009/0151347 | A1 * | 6/2009 | Nagatsuka | E02F 9/2225 60/459 |
| 2014/0060026 | A1 | 3/2014 | Himoto et al. | |
| 2016/0010313 | A1 | 1/2016 | Sugiura et al. | |
| 2019/0186106 | A1 * | 6/2019 | Ogawa | E02F 9/22 |
| 2020/0032485 | A1 * | 1/2020 | Hijikata | E02F 9/2267 |

FOREIGN PATENT DOCUMENTS

| | | | |
|---|---|---|---|
| KR | 10-2014-0058692 | A | 5/2014 |
| KR | 10-2015-0110606 | A | 10/2015 |
| WO | WO 2016/147283 | A1 | 9/2016 |

OTHER PUBLICATIONS

Japanese-language Written Opinion (PCT/ISA/237) issued in PCT Application No. PCT/JP2017/012474 dated May 9, 2017 (three (3) pages).

Korean-language Office Action issued in counterpart Korean Application No. 10-2018-7024183 dated Sep. 27, 2019 (five (5) pages).

International Preliminary Report on Patentability (PCT/IB/338 & PCT/IB/373) issued in PCT Application No. PCT/JP2017/012474 dated Oct. 10, 2019, including English translation of document C2 (Japanese-language Written Opinion (PCT/ISA/237 previously filed on Sep. 6, 2018)) (six (6) pages).

* cited by examiner

WORK MACHINE HYDRAULIC CONTROL SYSTEM

TECHNICAL FIELD

The present invention relates to a work machine such as a hydraulic excavator and, in particular, to a hydraulic control system of a work machine equipped with an accumulator.

BACKGROUND ART

Patent Document 1 discloses a hydraulic control system of a hydraulic excavator. In the following, this will be described in detail.

The hydraulic control system of the hydraulic excavator is equipped with a main pump and a pilot pump driven by an engine, a hydraulic actuator (more specifically, a boom cylinder, for example) driven by a hydraulic fluid delivered from the main pump, a control valve controlling the flow of the hydraulic fluid from the main pump to the hydraulic actuator, and a pilot valve operating the control valve.

Using the pressure of the hydraulic fluid supplied from one of the pilot pump and an accumulator described below as an original pressure (primary pressure), the pilot valve generates a pilot pressure (secondary pressure) corresponding to the operation amount of an operation lever, and operates the control valve by this pilot pressure.

The hydraulic control system of the hydraulic excavator is further equipped with a hydraulic line connecting the delivery side of the pilot pump and the pilot valve, a pump check valve provided in the hydraulic line, an unloading valve connected to the pilot pump side with respect to the pump check valve of the hydraulic line, a relief valve connected to the pilot pump side with respect to the pump check valve of the hydraulic line, an accumulator connected to the pilot valve side with respect to the pump check valve of the hydraulic line, a pressure sensor provided on the pilot valve side with respect to the pump check valve of the hydraulic line, and a controller.

The pump check valve permits the flow of the hydraulic fluid from the pilot pump to the pilot valve and the accumulator, and prevents the flow of the hydraulic fluid from the accumulator to the pilot pump. The pressure sensor detects the pressure of the hydraulic fluid supplied to the pilot valve and outputs it to the controller.

The controller selectively switches the unloading valve between an interruption position and a communication position in accordance with the pressure detected by the pressure sensor. In the case where the unloading valve is at the interruption position, the hydraulic fluid delivered from the pilot pump is supplied to the pilot valve and the accumulator. On the other hand, in the case where the unloading valve is at the communication position, the hydraulic fluid delivered from the pilot pump flows to a tank via the unloading valve. This helps to reduce the output power of the pilot pump.

In the case where the unloading valve is at the interruption position (that is, when the output power of the pilot pump is high), the accumulator accumulates a portion of the hydraulic fluid delivered from the pilot pump. On the other hand, in the case where the unloading valve is at the communication position (that is, when the output power of the pilot pump is low), the accumulator supplies the hydraulic fluid to the pilot valve.

The hydraulic control system of the hydraulic excavator is further equipped with a recovery line for supplying the return fluid from the boom cylinder to the accumulator, a regeneration valve provided in the recovery line, a regeneration check valve provided between the regeneration valve and the accumulator, and a pilot pressure sensor.

The regeneration check valve allows the flow of the hydraulic fluid from the regeneration valve to the accumulator, and prevents the flow of the hydraulic fluid from the accumulator to the regeneration valve. The pilot pressure sensor detects the pilot pressure output from the pilot valve to the control valve and outputs it to the controller.

The controller selectively switches the regeneration valve between the interruption position and the communication position in accordance with the pressure detected by the pressure sensor and the pilot pressure detected by the pilot pressure sensor. In the case where the regeneration valve is at the communication position, the return fluid from the boom cylinder is supplied to the accumulator.

PRIOR ART DOCUMENT

Patent Document

Patent Document 1: International Publication No. 2016/147283

SUMMARY OF THE INVENTION

Problem to be Solved by the Invention

In the above-described hydraulic control system of the hydraulic excavator, in the case where the hydraulic fluid accumulated in the accumulator is sufficient, the unloading valve (in other words, the pump output power switching device) is switched from the interruption position to the communication position, whereby the output power of the pilot pump is reduced, and fuel consumption of engine is improved. In the case, however, where the unloading valve is stuck at the interruption position for some reason, the output power of the pilot pump cannot be reduced, and fuel consumption of engine cannot be improved sufficiently. Also in the case where the unloading valve is stuck at an intermediate position between the interruption position and the communication position for some reason, the output power of the pilot pump cannot be reduced sufficiently, and fuel consumption of engine cannot be improved sufficiently. In the case where the unloading valve is stuck at the communication position for some reason, there is the possibility of the hydraulic fluid in the accumulator being lost with passage of time and of the pilot valve losing its function.

This might be coped with, for example, by detecting abnormality in the unloading valve by the pressure value detected by the pressure sensor. In this method, if abnormality in the state in which the unloading valve is stuck at the communication position is generated, the pressure value deviates from the normal range, so that the abnormality can be detected. If, however, abnormality in the state in which the unloading valve is stuck at the interruption position or the intermediate position is generated, the pressure value is in the normal range, so that the abnormality cannot be detected.

The present invention has been made in view of the above problem. The object of the present invention is to provide a work machine hydraulic control system capable of detecting abnormality in a pump output power switching device independently of the state of the abnormality in the pump output power switching device.

Means for Solving the Problem

To achieve the above object, there is provided, in accordance with the present invention, a work machine hydraulic control system including: a hydraulic pump; a hydraulic apparatus connected to a delivery side of the hydraulic pump; a pump output power switching device selectively switching the hydraulic pump between a high output power and a low output power; an accumulator connected to a hydraulic line between the hydraulic pump and the hydraulic apparatus, accumulating a portion of the hydraulic fluid delivered from the hydraulic pump when the hydraulic pump is of high output power, and supplying the hydraulic fluid to the hydraulic apparatus when the hydraulic pump is of low output power; a pump check valve permitting flow of the hydraulic fluid from the hydraulic pump to the hydraulic apparatus and the accumulator and preventing flow of the hydraulic fluid from the accumulator to the hydraulic pump; a pressure sensor detecting the pressure of the hydraulic fluid supplied to the hydraulic apparatus from one of the hydraulic pump and the accumulator; and a controller having a pump output power control section that in the case where pressure value of the pressure sensor is not less than a previously set upper limit value when the hydraulic pump is of high output power, outputs a low output power command to the pump output power switching device in order to switch the hydraulic pump to low output power, and that in the case where pressure value of the pressure sensor is not more than a previously set lower limit value when the hydraulic pump is of low output power, outputs a high output power command to the pump output power switching device in order to switch the hydraulic pump to high output power, wherein the controller further includes an abnormality determination section that computes a command continuation time in a state in which the command output from the pump output power control section to the pump output power switching device is not changed, and that in the case where the command continuation time is not less than a previously set predetermined value, determines that there is abnormality in the pump output power switching device, and outputs the determination result.

Effect of the Invention

According to the present invention, there is computed the command continuation time in the state in which the command output to the pump output power switching device is not changed, and in the case where this command continuation time is not less than a predetermined value, it is determined that the pump output power switching device is abnormal. As a result, independently of the abnormality state of the pump output power switching device, it is possible to detect abnormality in the pump output power switching device.

MODES FOR CARRYING OUT THE INVENTION

The first embodiment of the present invention will be described with reference to the drawings.

Figure 1:
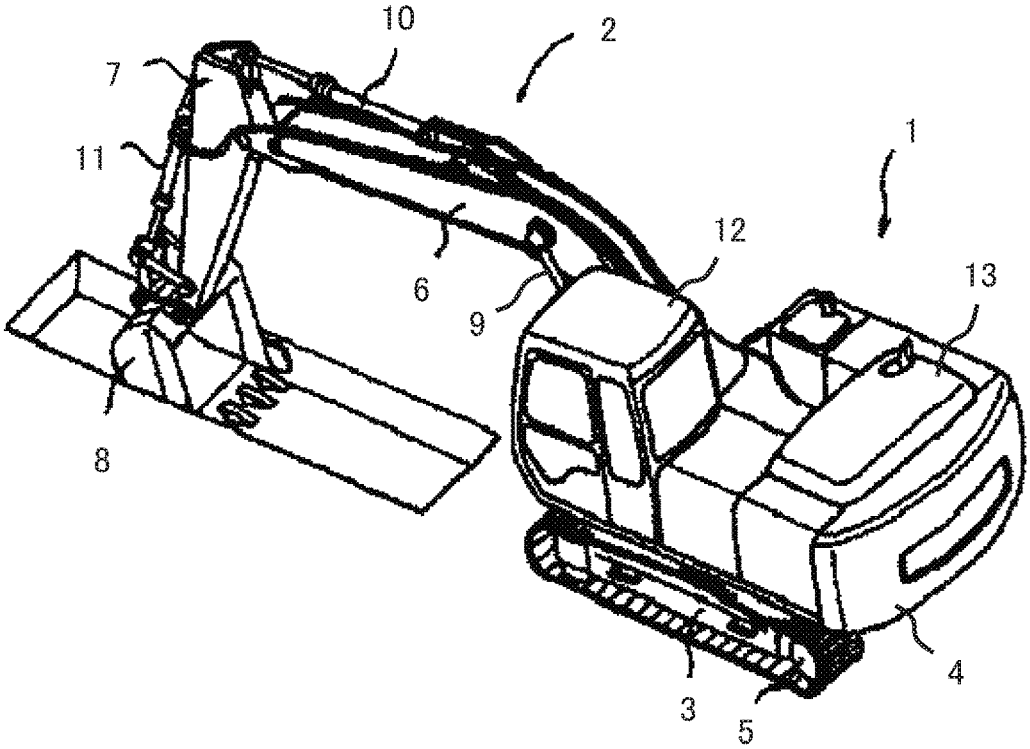
FIG. 1 is a perspective view illustrating the structure of a hydraulic excavator according to a first embodiment of the present invention.

FIG. 1 is a diagram illustrating the structure of a hydraulic excavator according to the present embodiment.

The hydraulic excavator of the present embodiment is equipped with a machine body 1 and a front work device 2. The machine body 1 is composed of a crawler type lower track structure 3 and an upper swing structure 4 swingably provided on top of the lower track structure 3. The lower track structure 3 travels due to the rotation of left and right traveling motors 5 (of which solely the left traveling motor 5 is shown in FIG. 1). The upper swing structure 4 swings due to the rotation of a swing motor (not shown).

The front work device 2 is equipped with a boom 6 connected to the front portion of the upper swing structure 4 so as to be vertically rotatable, an arm 7 connected to the boom 6 so as to be vertically rotatable, and a bucket 8 connected to the arm 7 so as to be vertically rotatable. The boom 6, the arm 7, and the bucket 8 rotate respectively due to the expansion/contraction driving of a boom cylinder 9, an arm cylinder 10, and a bucket cylinder 11.

A cab 12 is provided in the front portion of the upper swing structure 4, and a machine chamber 13 is provided in the rear portion of the upper swing structure 4. Mounted in the machine chamber 13 are apparatuses such as an engine 14 (See FIG. 2).

Provided in the cab 12 are a driver's seat (not shown) on which the operator is seated, and left and right traveling operation members (although not shown in detail, each of them is formed by integrating an operation pedal and an operation lever with each other). The operator operates the left traveling operation member in the front-rear direction to command the operation of the left traveling motor 5, and operates the right traveling operation member in the front-rear direction to command the operation of the right traveling motor 5.

Figure 2:
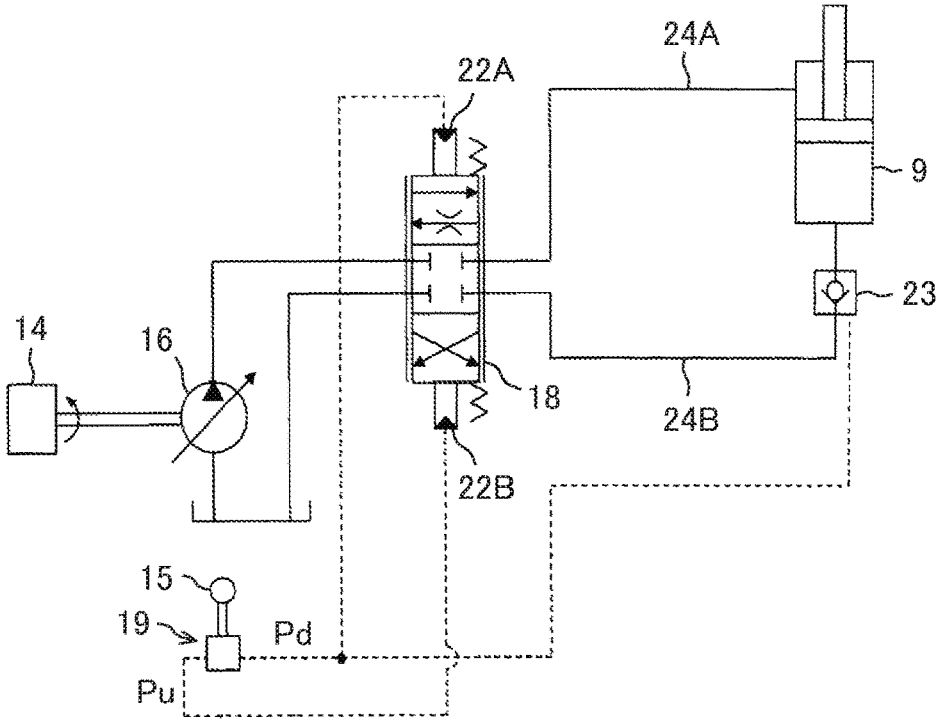
FIG. 2 is a diagram illustrating, of the structure of a hydraulic control system of the hydraulic excavator according to the first embodiment of the present invention, the structure of a main circuit related to the driving of a boom cylinder.
Figure 3:
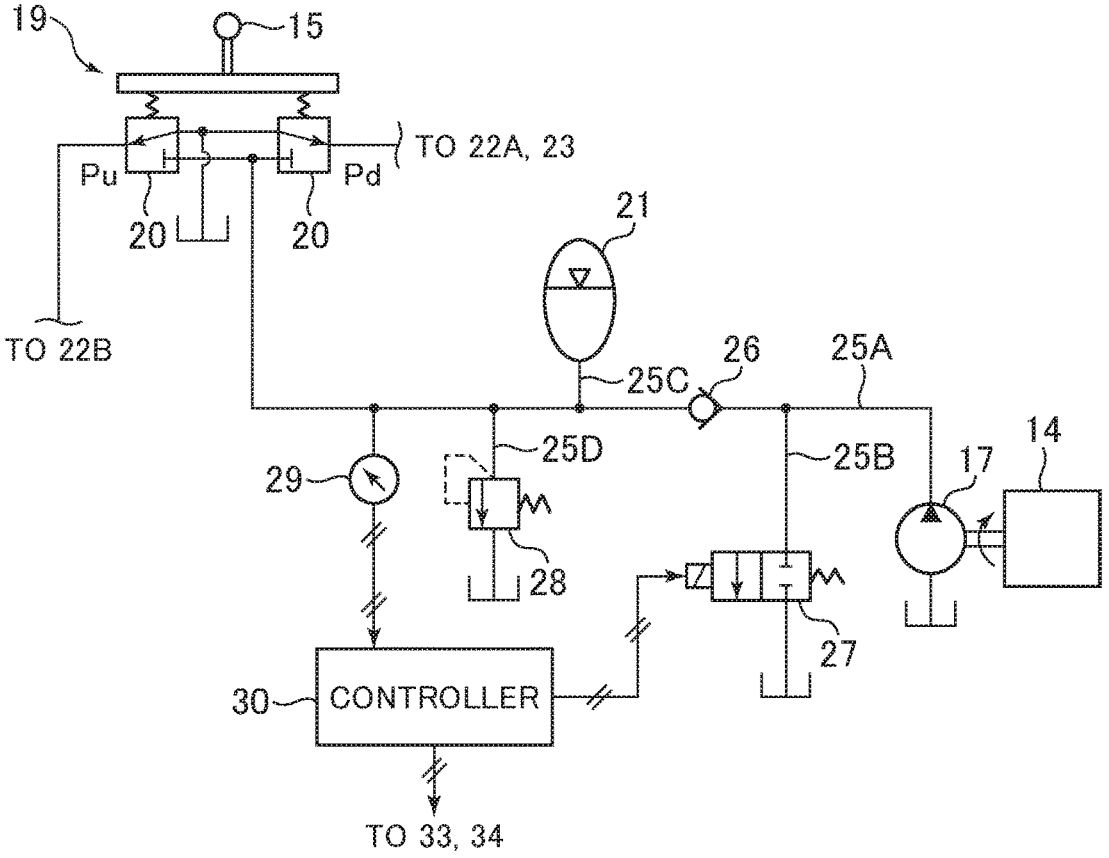
FIG. 3 is a diagram illustrating, of the structure of the hydraulic control system of the hydraulic excavator according to the first embodiment of the present invention, the structure of a pilot circuit related to the driving of the boom cylinder.

Further, provided in the cab 12 are a left work operation member (which, although not shown, is more specifically an operation lever), and a right work operation member 15 (which is an operation lever as shown in FIGS. 2 and 3). The operator operates the left work operation member in the front-rear direction to command the operation of the arm cylinder 10, and operates the left work operation member in the right-left direction to command the operation of the swing motor. Further, the operator operates the right work operation member 15 in the front-rear direction to command the operation of the boom cylinder 9, and operates the right work operation member 15 in the right-left direction to command the operation of the bucket cylinder 11.

Figure 4:
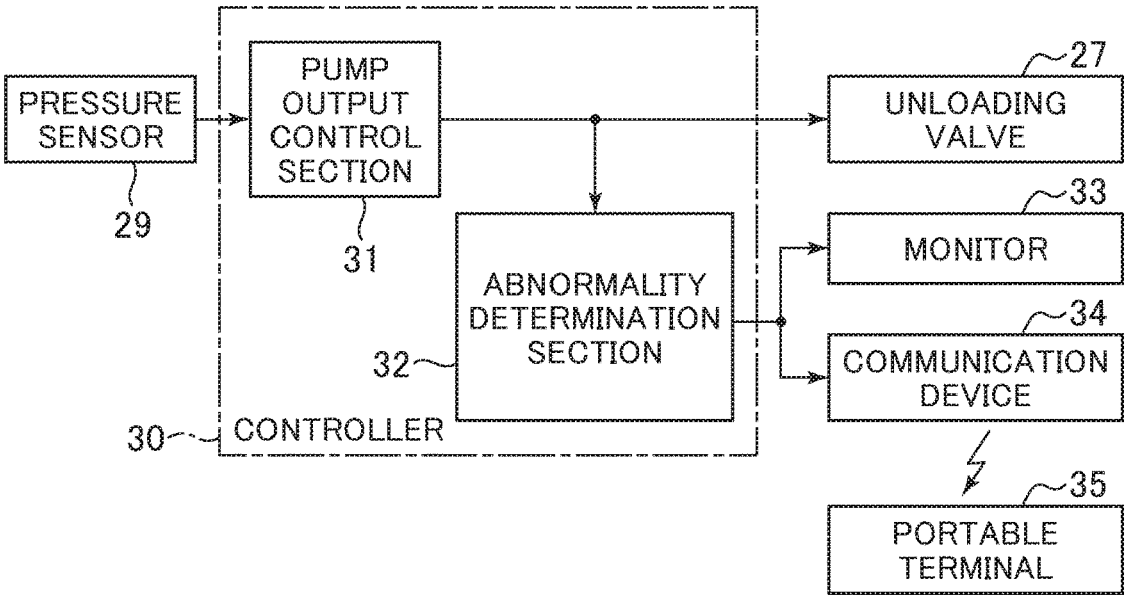
FIG. 4 is a block diagram illustrating the functional structure of a controller according to the first embodiment of the present invention along with related apparatuses.

Next, a hydraulic control system of the hydraulic excavator of the present embodiment will be described. FIG. 2 is a diagram illustrating, of the structure of the hydraulic control system of the hydraulic excavator according to the present embodiment, the structure of a main circuit related to the driving of the boom cylinder 9. FIG. 3 is a diagram illustrating, of the structure of the hydraulic control system of the hydraulic excavator according to the present embodiment, the structure of a pilot circuit related to the driving of the boom cylinder 9. FIG. 4 is a block diagram illustrating the functional structure of a controller according to the present embodiment along with related apparatuses.

The hydraulic control system of the present embodiment is equipped with the engine 14, a variable displacement type main pump 16 and a fixed displacement type pilot pump 17 that are driven by the engine 14, the boom cylinder 9 (hydraulic actuator) driven by the hydraulic fluid delivered from the main pump 16, a pilot operation type control valve 18 controlling the flow of the hydraulic fluid from the main pump 16 to the boom cylinder 9, and an operation device 19 operating the control valve 18.

The operation device 19 has the work operation member 15, and a pair of pilot valves 20 (hydraulic apparatuses) operated through the operation in the front-rear direction of the operation member 15. Using the pressure of the hydraulic fluid supplied from one of the pilot pump 17 (hydraulic pump) and an accumulator 21 described below as the original pressure (primary pressure), the pilot valves 20 generate a pilot pressure (secondary pressure) corresponding to the operation amount of the operation member 15, and the control valve 18 is operated by this pilot pressure.

More specifically, one pilot valve 20 generates a pilot pressure Pd corresponding to the front side operation amount of the operation member 15, and outputs this pilot pressure Pd to the pressure receiving portion 22A of the control valve 18 to switch the control valve 18. As a result, the hydraulic fluid is supplied from the main pump 16 to the rod side fluid chamber of the boom cylinder 9, and the hydraulic fluid is discharged from the bottom side fluid chamber of the boom cylinder 9, with the boom cylinder 9 contracting. Thus, the boom 6 is lowered. The pilot pressure Pd is also output to a pilot operation type check valve 23 described below.

The other pilot valve 20 generates a pilot pressure Pu corresponding to the rear side operation amount of the operation member 15, and outputs this pilot pressure Pu to the pressure receiving portion 22B of the control valve 18 to switch the control valve 18. As a result, the hydraulic fluid is supplied from the main pump 16 to the bottom side fluid chamber of the boom cylinder 9, and the hydraulic fluid is discharged from the rod side fluid chamber of the boom cylinder 9, with the boom cylinder 9 expanding. Thus, the boom 6 rises.

The control valve 18 and the rod side fluid chamber of the boom cylinder 9 are connected to each other by a line 24A. The control valve 18 and the bottom side fluid chamber of the boom cylinder 9 are connected to each other by a line 24B, and the line 24B is provided with a pilot operation type check valve 23. In the case where the pilot pressure Pd from the pilot valve 20 is not input, the check valve 23 permits the inflow of the hydraulic fluid to the bottom side fluid chamber of the boom cylinder 9. However, it prevents the discharge of the hydraulic fluid from the bottom side fluid chamber of the boom cylinder 9 (back flow preventing function). As a result, contraction of the boom cylinder 9 is prevented due to the weight of the front work device 2. In the case where the pilot pressure Pd from the pilot valve 20 is input, the above-mentioned back flow preventing function is nullified. As a result, the discharge of the hydraulic fluid from the bottom side fluid chamber of the boom cylinder 9 is permitted.

The hydraulic control system of the present embodiment is further equipped with a hydraulic line 25A connecting the delivery side of the pilot pump 17 and the pilot valves 20, a pump check valve 26 provided in the hydraulic line 25A, an unloading valve 27 (pump output power switching device) connected to the pilot pump 17 side of the hydraulic line 25A with respect to the pump check valve 26 via a hydraulic line 25B, an accumulator 21 connected to the pilot valve 20 side of the hydraulic line 25A with respect to the pump check valve 26 via a hydraulic line 25C, a relief valve 28 connected to the pilot valve 20 side of the hydraulic line 25A with respect to the pump check valve 26 via a hydraulic line 25D, a pressure sensor 29 provided on the pilot valve 20 side of the hydraulic line 25A with respect to the pump check valve 26, and a controller 30.

The pump check valve 26 permits the flow of the hydraulic fluid from the pilot pump 17 to the pilot valves 20 and the accumulator 21, and prevents the flow of the hydraulic fluid from the accumulator 21 to the pilot pump 17.

The unloading valve 27 is selectively switched between the interruption position and the communication position, thereby selectively switching the pilot pump 17 between high output power and low output power. More specifically, in the case where the unloading valve 27 is at the interruption position, the hydraulic fluid delivered from the pilot pump 17 is supplied to the pilot valves 20 and the accumulator 21. On the other hand, in the case where the unloading valve 27 is at the communication position, the hydraulic fluid delivered from the pilot pump 17 flows to the tank via the unloading valve 27. As a result, the output power of the pilot pump 17 is reduced.

In the case where the unloading valve 27 is at the interruption position (that is, when the pilot pump 17 is of high output power), the accumulator 21 accumulates a portion of the hydraulic fluid delivered from the pilot pump 17. On the other hand, in the case where the unloading valve 27 is at the communication position (that is, when the pilot pump 17 is of low output power), the accumulator 21 supplies the hydraulic fluid to the pilot valves 20.

The relief valve 28 limits the pressure Pi of the hydraulic fluid supplied to the pilot valves 20 so that it may not exceed a prescribed pressure (which, in the preset embodiment, is the same as an upper limit value Ph described below). That is, in the case where the pressure Pi exceeds the prescribed pressure, the relief valve 28 causes the hydraulic fluid in the hydraulic line 25A to flow to the tank. The pressure sensor 29 detects the pressure Pi of the hydraulic fluid supplied to the pilot valves 20 and outputs it to the controller 30.

The controller 30 has a computation control section (e.g., CPU) executing computation processing and control processing based on a program, a storage section (e.g., ROM or RAM) storing a program and computation processing results, etc. As functional components, the controller 30 has a pump output power control section 31 and an abnormality determination section 32.

Figure 5:
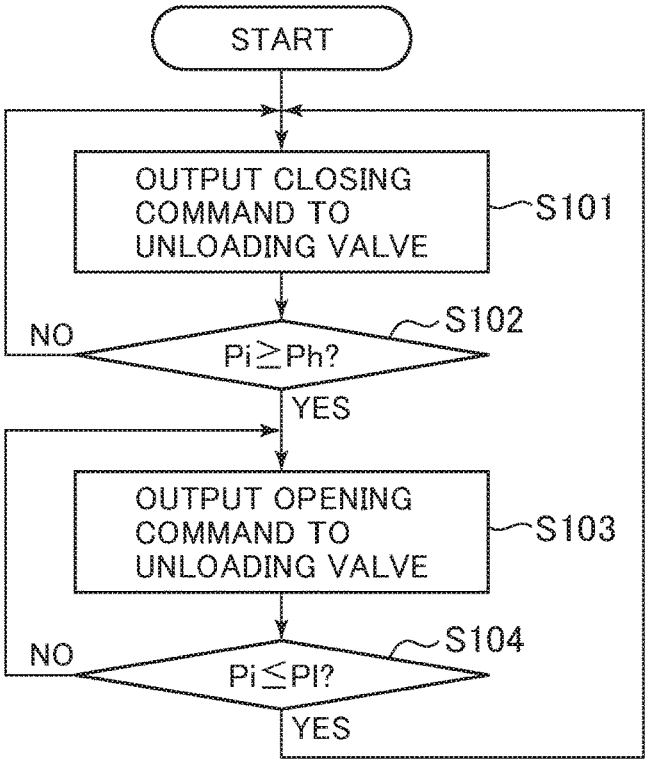
FIG. 5 is a flowchart illustrating the processing of a pump output power control section of the controller of the first embodiment of the present invention.

The pump output power control section 31 of the controller 30 controls the unloading valve 27 in accordance with the pressure Pi detected by the pressure sensor 29. This will be described in detail with reference to FIG. 5. FIG. 5 is a flowchart illustrating the processing of the pump output power control section 31 of the controller 30 according to the present embodiment.

In step S101, the pump output power control section 31 outputs a closing command (high output power command) to the unloading valve 27 (more specifically, it outputs no drive signal), and places the unloading valve 27 at the interruption position. As a result, the hydraulic fluid delivered from the pilot pump 17 is supplied to the pilot valves 20 and the accumulator 21. Thus, a portion of the hydraulic fluid delivered from the pilot pump 17 is accumulated in the accumulator 21, and the pressure Pi of the hydraulic fluid supplied to the pilot valves 20 increases.

The procedure advances to step S102, where the pump output power control section 31 determines whether or not the pressure value Pi of the pressure sensor 29 is the previously set upper limit value Ph or more. In the case where the pressure value Pi is less than the upper limit value Ph, the procedure returns to step S101 and procedures similar to the above ones are repeated. On the other hand, in the case where the pressure value Pi is the upper limit value Ph or more, the procedure returns to step S103.

In step S103, the pump output power control section 31 outputs an opening command (low output power command) to the unloading valve 27 (more specifically, outputs a drive signal), and places the unloading valve 27 at the communication position. As a result, the hydraulic fluid delivered from the pilot pump 17 is caused to flow to the tank via the unloading valve 27. Further, the hydraulic fluid accumulated in the accumulator 21 is supplied to the pilot valves 20. Thus, the pressure Pi of the hydraulic fluid supplied to the pilot valves 20 is lowered.

The procedure advances to step S104, where the pump output power control section 31 determines whether or not the pressure value Pi of the pressure sensor 29 is a previously set lower limit value Pl (Pl<Ph) or less. In the case where the pressure value Pi exceeds the lower limit value Pl, the procedure returns to step S103, where procedures described above are repeated. On the other hand, in the case where the pressure value Pi is the lower limit value Pl or less, the procedure returns to step S101, where procedures described above are repeated.

Figure 6:
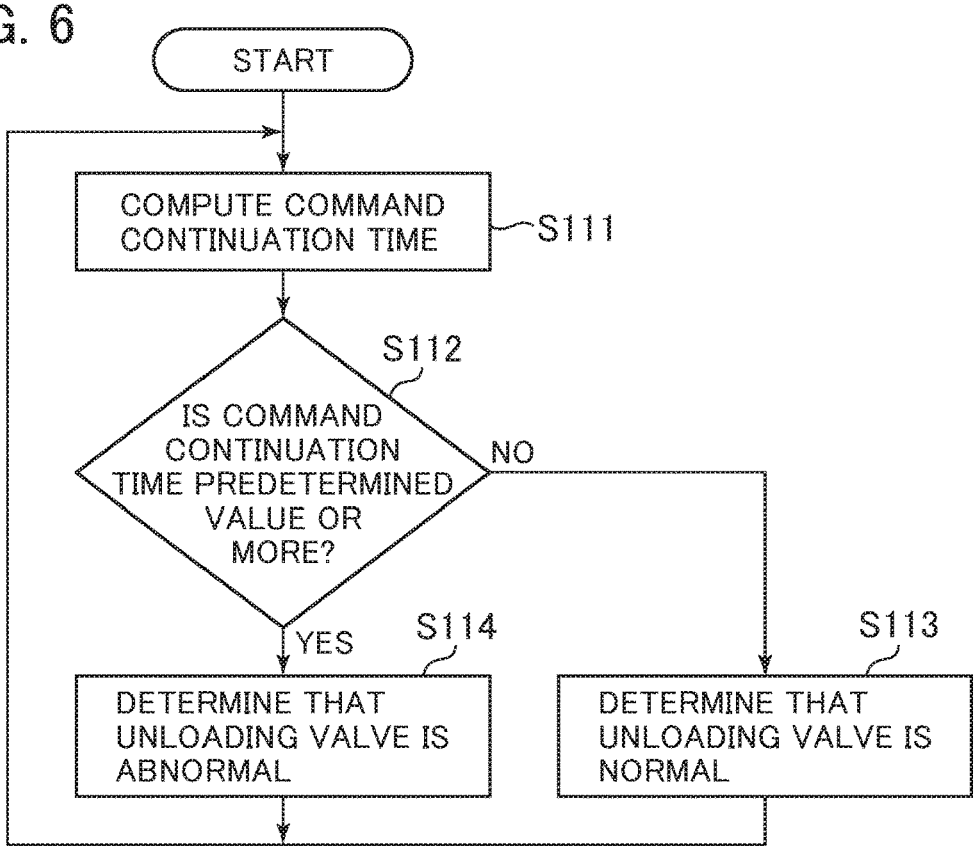
FIG. 6 is a flowchart illustrating the processing of an abnormality determination section of the controller of the first embodiment of the present invention.

The abnormality determination section 32 of the controller 30 which is the main section of the present embodiment computes a command continuation time in the state in which the command output from the pump output power control section 31 to the unloading valve 27 is not changed, and determines whether or not the unloading valve 27 is abnormal based on the command continuation time, outputting the determination result. This will be described in detail with reference to FIG. 6. FIG. 6 is a flowchart illustrating the processing of the abnormality determination section 32 of the controller 30 according to the present embodiment.

In step S111, the abnormality determination section 32 counts the time from the start of the output of the closing command to the unloading valve 27 to the switching to the output of the opening command as the command continuation time. Alternatively, the time from the start of the output of the opening command to the unloading valve 27 to the switching to the output of the closing command is counted.

Figure 7:
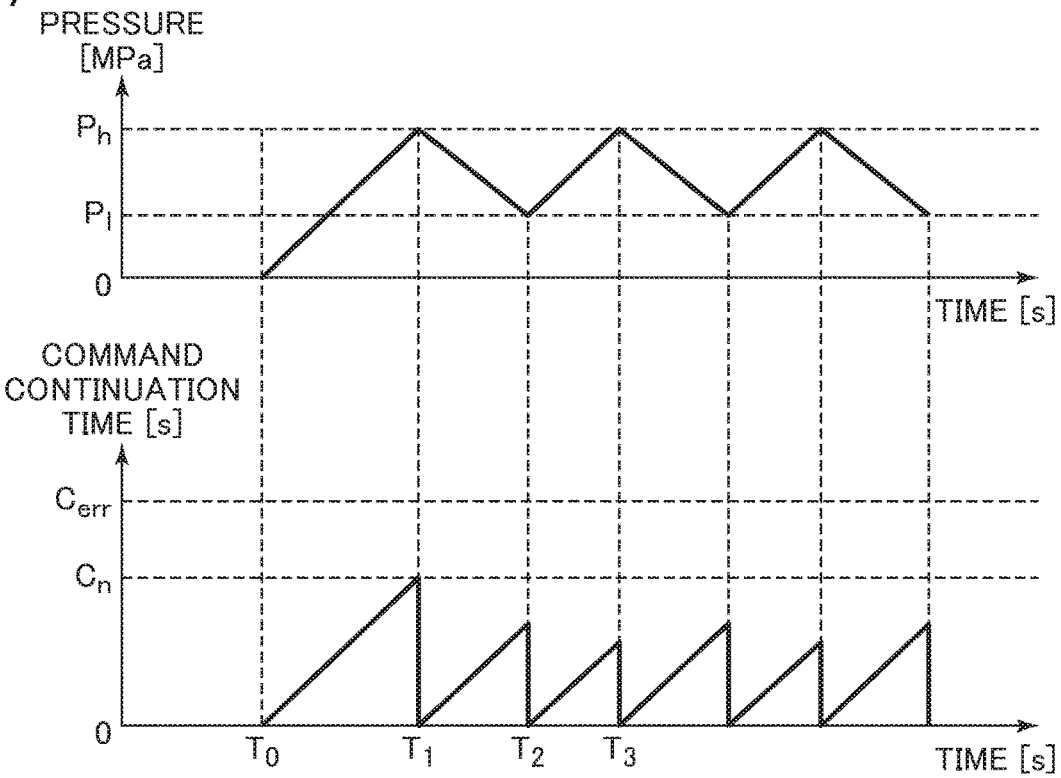
FIG. 7 is a time chart illustrating changes in a pressure value and changes in a command continuation time in the first embodiment of the present invention in the case where an unloading valve is normal.

The procedure advances to step S112, where the abnormality determination section 32 determines whether or not the command continuation time (count value) is a predetermined value Cerr (more specifically, a value, which, as shown in FIG. 7, is previously set so as to be larger than the maximum value Cn of the command continuation time in the case where the unloading valve 27 is normal) or more. In the case where the command continuation time is less than the predetermined value Cerr, the procedure advances to step S113, where it is determined that the unloading valve 27 is normal.

In the case where the command continuation time is the predetermined value Cerr or more, the procedure advances to step S114, where the abnormality determination section 32 determines that the unloading valve 27 is abnormal. Then, it transmits abnormality generation information to a monitor 33 in the cab 12 of the hydraulic excavator to display the same, thus informing the operator thereof. Further, it transmits the abnormality generation information to a portable terminal 35 carried about by the maintenance technician via a communication device 34 and to display the same, thus informing the maintenance technician thereof.

Next, the operation and effect of the present embodiment will be described with reference to FIGS. 7 through 10.

Figure 8:
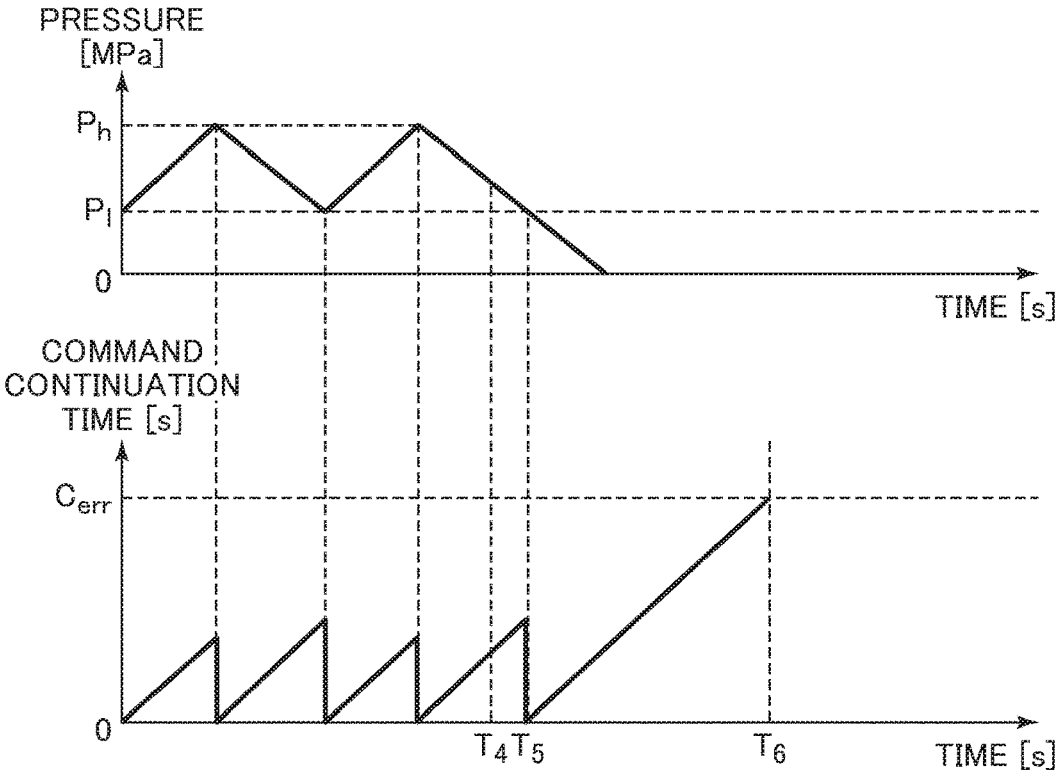
FIG. 8 is a time chart illustrating changes in the pressure value and changes in the command continuation time in the first embodiment of the present invention in the case where there has been generated an abnormality state in which the unloading valve is stuck at a communication position.
Figure 9:
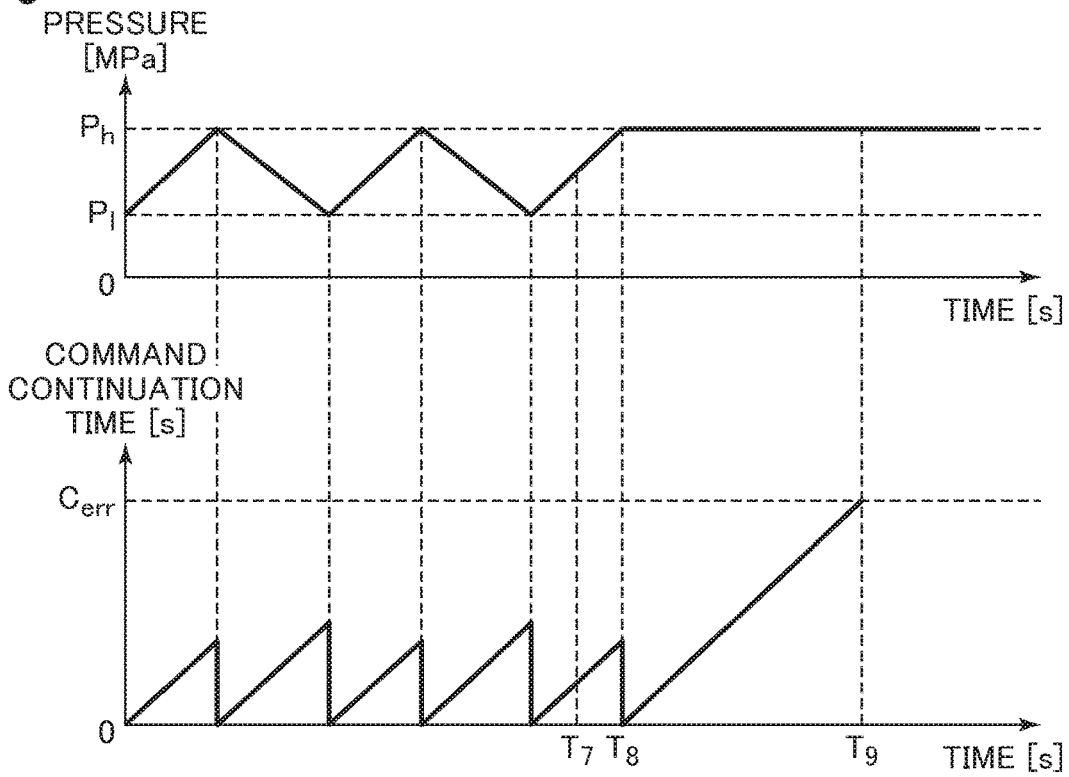
FIG. 9 is a time chart illustrating changes in the pressure value and changes in the command continuation time in the first embodiment of the present invention in the case where there has been generated an abnormality state in which the unloading valve is stuck at an interruption position.
Figure 10:
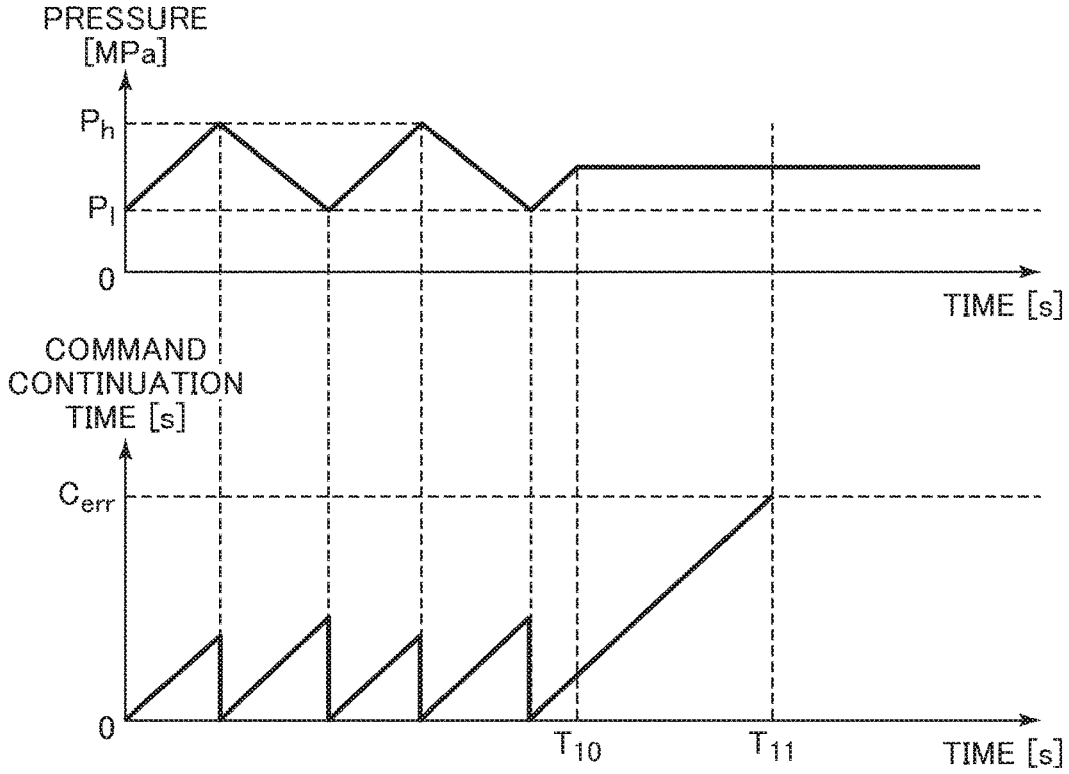
FIG. 10 is a time chart illustrating changes in the pressure value and changes in the command continuation time in the first embodiment of the present invention in the case where there has been generated an abnormality state in which the unloading valve is stuck at an intermediate position.

FIGS. 7 through 10 are time chart illustrating changes in the pressure value and changes in the command continuation time in the present embodiment. FIG. 7 illustrates the case where the unloading valve 27 is normal, FIG. 8 illustrates the case where there has been generated a state of abnormality in which the unloading valve 27 is stuck at the communication position, FIG. 9 illustrates the case where there has been generated a state of abnormality in which the unloading valve 27 is stuck at the interruption position, and FIG. 10 illustrates the case where there has been generated a state of abnormality in which the unloading valve 27 is stuck at the intermediate position.

First, the case where the unloading valve 27 is normal will be described with reference to FIG. 7. When, at the time of start (time T0) of the engine 14, no hydraulic fluid is accumulated in the accumulator 21, the pressure value Pi of the pressure sensor 29 is zero. The pump output power control section 31 of the controller 30 outputs a closing command to the unloading valve 27 to place the unloading valve 27 in the interruption state. As a result, the pressure value Pi of the pressure sensor 29 increases.

While the pressure value Pi of the pressure sensor 29 increases to the upper limit value Ph (from time T0 to time T1), the pump output power control section 31 of the controller 30 continues the output of the closing command to the unloading valve 27. All this while, the abnormality determination section 32 of the controller 30 counts the continuation time of the closing command, and since the continuation time of the closing command is less than the predetermined value Cerr, determines that the unloading valve 27 is normal. When the unloading valve 27 is normal, the closing command continuation time immediately after the start becomes the maximum value Cn.

When the pressure value Pi of the pressure sensor 29 increases to the upper limit value Ph (time T1), the pump output power control section 31 of the controller 30 outputs the opening command to the unloading valve 27, and places the unloading valve 27 in the communication state. As a result, the pressure value Pi of the pressure sensor 29 is lowered.

While the pressure value Pi of the pressure sensor 29 is lowered to the lower limit value Pl (from time T1 to time T2), the pump output power control section 31 of the controller 30 continues the output of the opening command of the unloading valve 27. All this while, the abnormality determination section 32 of the controller 30 counts the continuation time of the opening command, and since the continuation time of the opening command is less than the predetermined value Cerr, determines that the unloading valve 27 is normal.

When the pressure value Pi of the pressure sensor 29 is lowered to the lower limit value Pl (time T2), the pump output power control section 31 of the controller 30 outputs the closing command to the unloading valve 27 to place the unloading valve 27 in the interruption state. As a result, the pressure value Pi of the pressure sensor 29 increases.

While the pressure value Pi of the pressure sensor 29 increases to the upper limit value Ph (from time T2 to time T3), the pump output power control section 31 of the controller 30 continues the output of the closing command to the unloading valve 27. All this while, the abnormality determination section 32 of the controller 30 counts the continuation time of the closing command, and since the continuation time of the closing command is less than the predetermined value Cerr, determines that the unloading valve 27 is normal. From this onward, this processing is repeated.

Next, the case where an abnormality state in which the unloading valve 27 is stuck at the communication position is generated will be described with reference to FIG. 8. When the abnormality state in which the unloading valve 27 is stuck at the communication position is generated (time T4), and when, after this, the pressure value Pi of the pressure sensor 29 is lowered to attain Pl (time T5), the pump output power control section 31 of the controller 30 outputs the closing command to the unloading valve 27. Further, the abnormality determination section 32 of the controller 30 counts the continuation time of the closing command.

However, since the unloading valve 27 is in the state in which it is stuck at the communication position, switching from the communication position to the interruption position is not effected, and the pressure value Pi of the pressure sensor 29 is further lowered. The pressure value Pi does not become the upper limit value Ph or more, so that the continuation time of the closing command attains the predetermined value Cerr (time T6). As a result, the abnormality determination section 32 of the controller 30 determines that the unloading valve 27 is abnormal.

Next, the case where an abnormality state in which the unloading valve 27 is stuck at the interruption position is generated will be described with reference to FIG. 9. When the abnormality state in which the unloading valve 27 is stuck at the interruption position (time T7) is generated, and, when, after this, the pressure value Pi of the pressure sensor 29 increases to attain Ph (time T8), the pump output power control section 31 of the controller 30 outputs the opening command to the unloading valve 27. Further, the abnormality determination section 32 of the controller 30 counts the continuation time of the opening command.

However, since the unloading valve 27 is in the state in which it is stuck at the interruption position, switching from the interruption position to the communication position is not effected, and the pressure value Pi of the pressure sensor 29 attains the prescribed pressure of the relief valve 28 (which, in the present embodiment, is the upper limit value Ph). Since the pressure value Pi does not become the lower limit value Pl or less, the continuation time of the opening command attains the predetermined value Cerr (time T9). As a result, the abnormality determination section 32 of the controller 30 determines that the unloading valve 27 is abnormal.

Next, the case where an abnormality state in which the unloading valve 27 is stuck at the intermediate position between the communication position and the interruption position is generated will be described with reference to FIG. 10. When there is generated the abnormality state in which the unloading valve 27 is stuck at the intermediate position (time T10), the pressure value Pi of the pressure sensor 29 attains an intermediate value between the upper limit value Ph and the lower limit value Pl. The pressure value Pi does not become not less than the upper limit value Ph or not more than the lower limit value Pl, so that the command continuation time attains the predetermined value Cerr (time T11). As a result, the abnormality determination section 32 of the controller 30 determines that the unloading valve 27 is abnormal.

As described above, in the present embodiment, there is computed the command continuation time in the state in which the command output to the unloading valve 27 is not changed, and in the case where the command continuation time is not less than the predetermined value Cerr, it is determined that the unloading valve 27 is abnormal. As a result, independently of the abnormal state of the unloading valve 27 (in particular, the state in which the unloading valve 27 is stuck at the interruption position, and the state in which the unloading valve 27 is stuck at the intermediate position), it is possible to detect the abnormality in the unloading valve 27.

Figure 11:
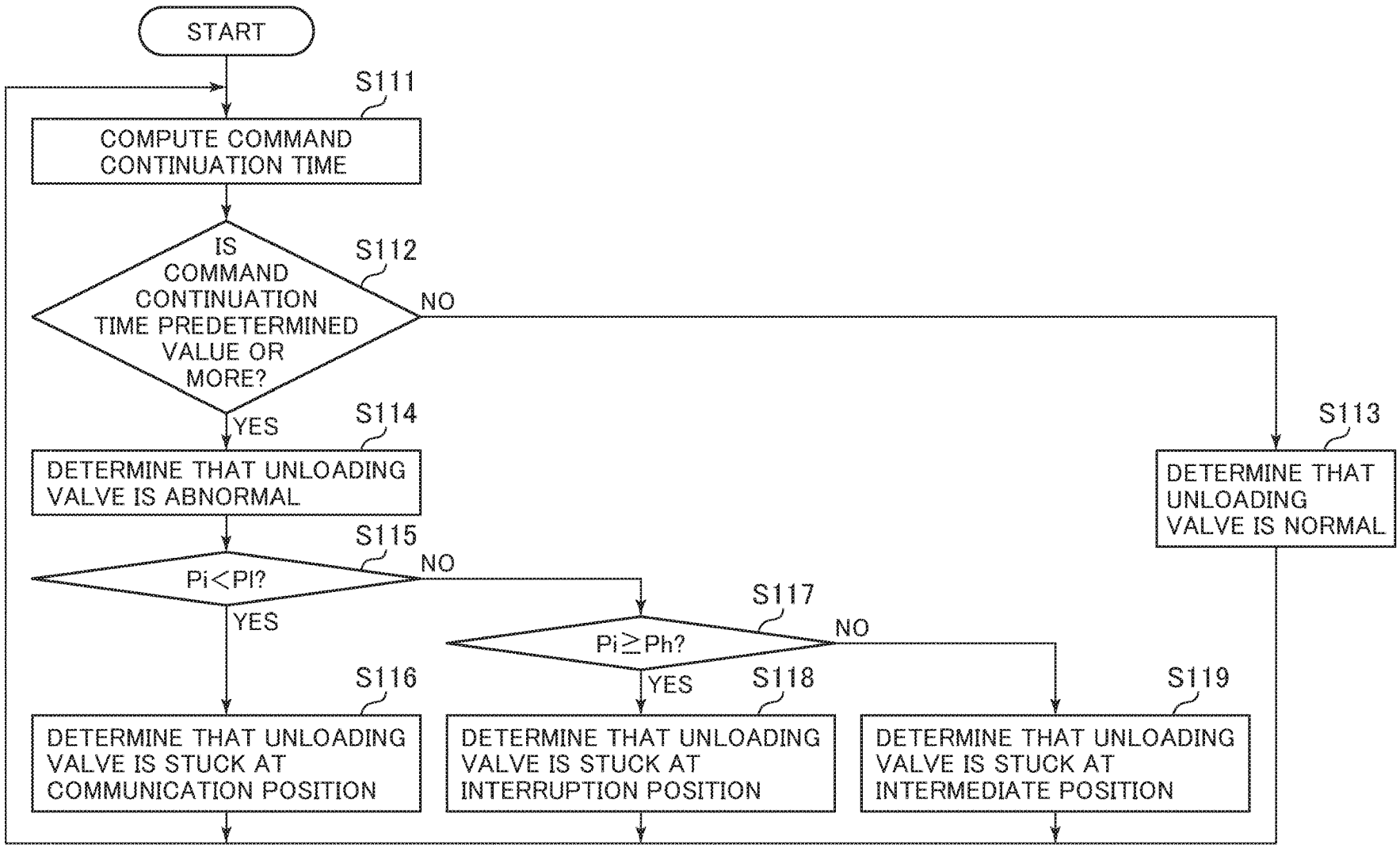
FIG. 11 is a flowchart illustrating the processing of an abnormality determination section of a controller according to a first modification of the present invention.

Although not described in particular in connection with the first embodiment, in the case where it is determined that the unloading valve 27 is abnormal, the abnormality determination section 32 of the controller 30 may distinguish the abnormality state in accordance with the pressure value Pi of the pressure sensor 29. Such a modification will be described with reference to FIG. 11. FIG. 11 is a flowchart illustrating the processing of the abnormality determination section 32 of the controller 30 in the present modification.

Steps S111 through S114 are the same as the first embodiment of FIG. 1. In step S114, the abnormality determination section 32 determines that the unloading valve 27 is abnormal, and then the procedure advances to step S115.

In step S115, the abnormality determination section 32 determines whether or not the pressure value Pi of the pressure sensor 29 is less than the lower limit value Pl. In the case where the pressure value Pi is less than the lower limit value Pl, the procedure advances to step S116, where it identifies the abnormality state in which the unloading valve 27 is stuck at the communication position. In the case where the pressure value Pi is the lower limit value Pl or more, the procedure advances to step S117, where it determines whether or not the pressure value Pi of the pressure sensor 29 is the upper limit value Ph or more. In the case where the pressure value Pi is the upper limit value Ph or more, the procedure advances to step S118, where it identifies the abnormality state in which the unloading valve 27 is stuck at the interruption position. In the case where the pressure value Pi is less than the upper limit value Ph, the procedure advances to step S119, and it identifies the abnormality state in which the unloading valve 27 is stuck at the intermediate position.

Then, the abnormality determination section 32 of the controller 30 transmits the abnormality generation information and the abnormality state information of the unloading valve 27 to the monitor 33 and the portable terminal 35 to display the information. This helps to cope with abnormality in the unloading valve 27.

The second embodiment of the present invention will be described with reference to FIGS. 12 through 15. In the present embodiment, the components that are the same as or equivalent to those of the first embodiment are indicated by the same reference numerals, and a description thereof will be left out as appropriate.

Figure 12:
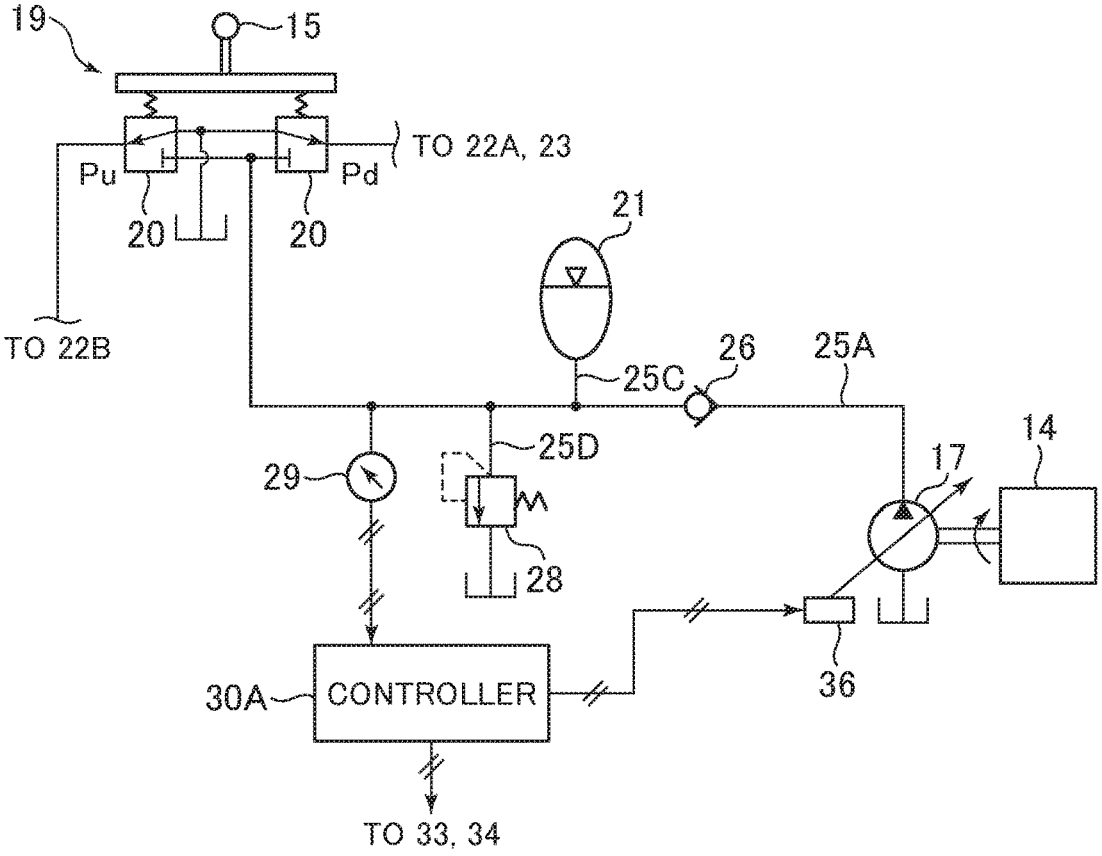
FIG. 12 is a diagram illustrating, of the structure of a hydraulic control system of the hydraulic excavator according to a second embodiment of the present invention, the structure of a pilot circuit related to the driving of the boom cylinder.
Figure 13:
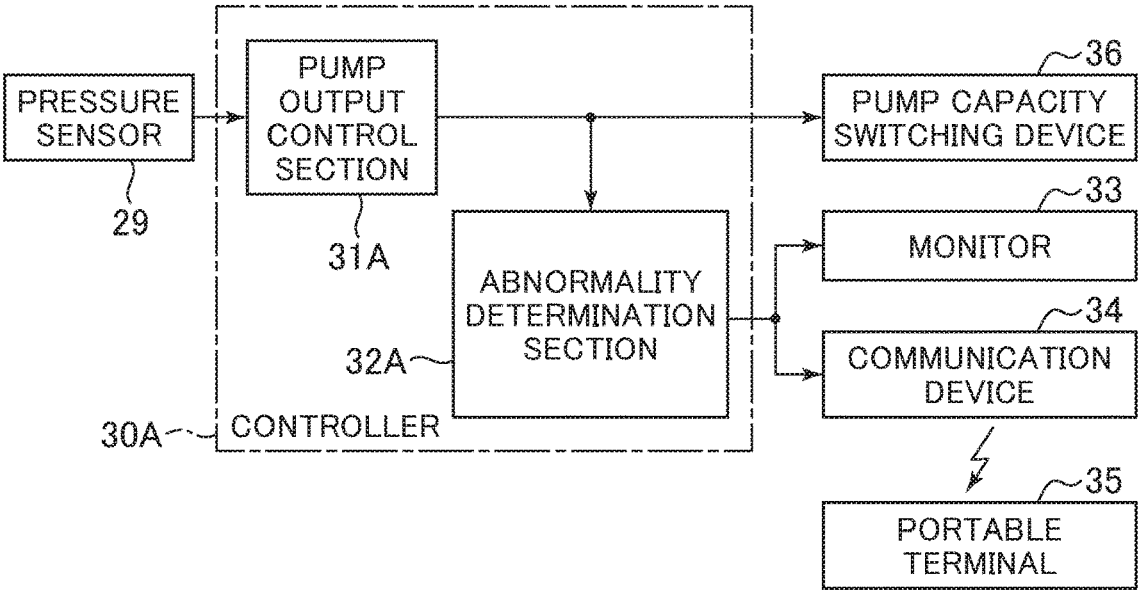
FIG. 13 is a block diagram illustrating the functional structure of a controller according to the second embodiment of the present invention along with related apparatuses.

FIG. 12 is a diagram illustrating, of the structure of a hydraulic control system of the hydraulic excavator according to the present embodiment, the structure of a pilot circuit related to the driving of the boom cylinder 9. FIG. 13 is a block diagram illustrating the functional structure of a controller according to the present embodiment along with related apparatuses.

In the hydraulic control system of the present embodiment, the pilot pump 17A is of the variable displacement type. Instead of the unloading valve 27 of the first embodiment, there is provided a pump capacity switching device 36 which selectively switches the pilot pump 17A between large capacity and small capacity that are previously set. The pump capacity switching device 36 switches the tilting angle of a swash plate of the pilot pump 17A, whereby the capacity of the pilot pump 17A is switched.

In the case where the pilot pump 17A is of large capacity (that is, when the pilot pump 17 is of high output power), the accumulator 21 accumulates a portion of the hydraulic fluid delivered from the pilot pump 17. On the other hand, in the case where the pilot pump 17A is of small capacity (that is, when the pilot pump 17 is of low output power), the accumulator 21 supplies the hydraulic fluid to the pilot valves 20.

Figure 14:
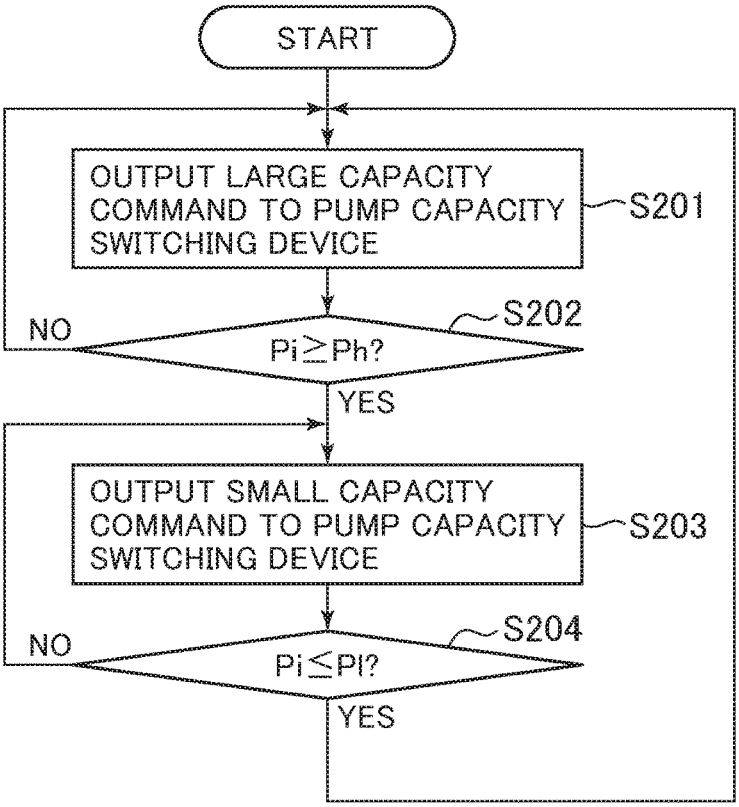
FIG. 14 is a flowchart illustrating the processing of a pump output power control section of the controller of the second embodiment of the present invention.

A pump output power control section 31A of a controller 30A controls the pump capacity switching device 36 in accordance with the pressure Pi detected by the pressure sensor 29. This will be described in detail with reference to FIG. 14. FIG. 14 is a flowchart illustrating the processing of the pump output power control section 31A of the controller 30A of the present embodiment.

In step S201, the pump output power control section 31A outputs a large capacity command (high output power command) to the pump capacity switching device 36. In accordance with this large capacity command, the pump capacity switching device 36 sets the pilot pump 17 to large capacity. As a result, the hydraulic fluid delivered from the pilot pump 17 is supplied to the pilot valves 20 and the accumulator 21. Thus, a portion of the hydraulic fluid delivered from the pilot pump 17 is accumulated in the accumulator 21 and, at the same time, the pressure Pi of the hydraulic fluid supplied to the pilot valves 20 increases.

The procedure advances to step S202, where the pump output power control section 31A determines whether or not the pressure value Pi of the pressure sensor 29 is the upper limit value Ph or more. In the case where the pressure value Pi is less than the upper limit value Ph, the procedure returns to step S201, and procedures similar to those described above are repeated. On the other hand, in the case where the pressure value Pi is the upper limit value Ph or more, the procedure advances to step S203.

In step S203, the pump output power control section 31A outputs a small capacity command (low output power command) to the pump capacity switching device 36. In accordance with this small capacity command, the pump capacity switching device 36 sets the pilot pump 17 to small capacity. As a result, the hydraulic fluid accumulated in the accumulator 21 is supplied to the pilot valves 20. Thus, the pressure Pi of the hydraulic fluid supplied to the pilot valves 20 is lowered.

The procedure advances to step S204, where the pump output power control section 31A determines whether or not the pressure value Pi of the pressure sensor 29 is the lower limit value Pl or less. In the case where the pressure value Pi exceeds the lower limit value Pl, the procedure returns to step S203, and procedures described above are repeated. On the other hand, in the case where the pressure value Pi is the lower limit value Pl or less, the procedure returns to step S201, and procedures similar to those described above are repeated.

Figure 15:
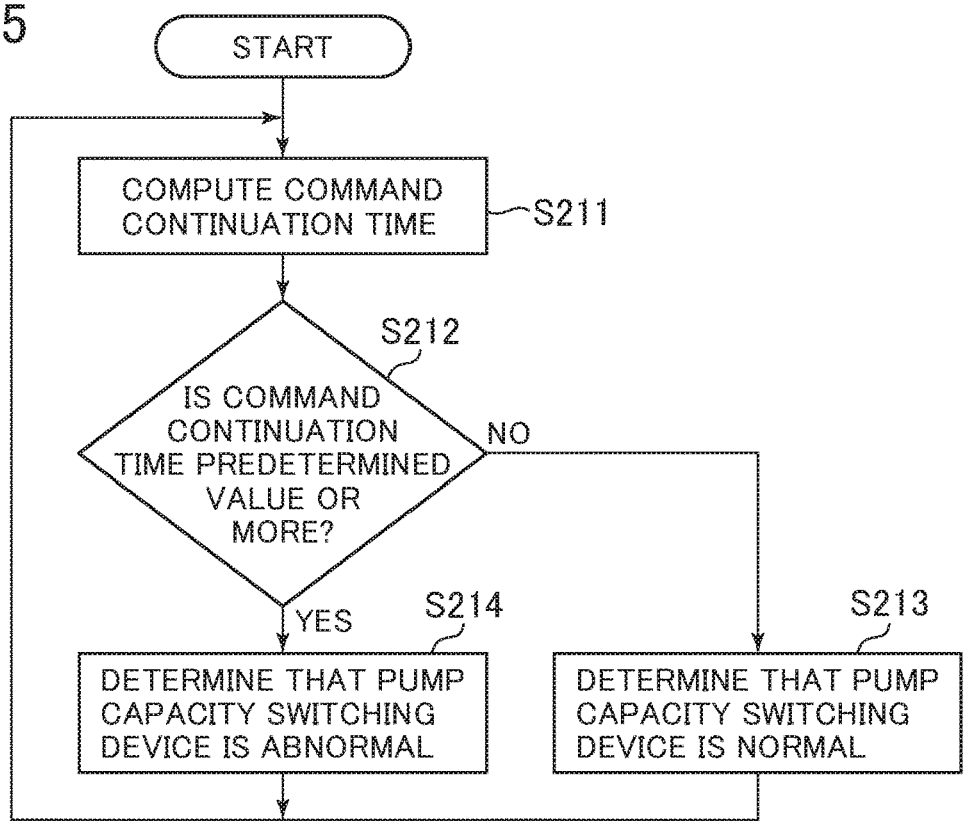
FIG. 15 is a flowchart illustrating the processing of an abnormality determination section of the controller of the second embodiment of the present invention.

An abnormality determination section 32A of the controller 30A, which is the main section of the present embodiment, computes a command continuation time in the state in which the command output from the pump output power control section 31A to the pump capacity switching device 36 is not changed, and, based on this command continuation time, determines whether or not the pump capacity switching device 36 is abnormal to output the determination result. This will be described in detail with reference to FIG. 15. FIG. 15 is a flowchart illustrating the processing of the abnormality determination section 32A of the controller 30A according to the present embodiment.

In step S211, as the command continuation time, the abnormality determination section 32A counts the time from the start of the output of the large capacity command to the pump capacity switching device 36 to the switching to the output of the small capacity command. Alternatively, it counts the time from the start of the output of the small capacity command to the pump capacity switching device 36 to the switching to the output of the large capacity command.

The procedure advances to step S212, where the abnormality determination section 32A determines whether or not the command continuation time (count value) is a predetermined value (more specifically, a value set previously so as to be more than the maximum command continuation time in the case where the pump capacity switching device 36 is normal) or more. In the case where the command continuation time is less than the predetermined value, the procedure advances to step S213, where it determines that the pump capacity switching device 36 is normal.

In the case where the command continuation time is the predetermined time or more, the procedure advances to step S214, where the abnormality determination section 32A determines that the pump capacity switching device 36 is abnormal. Then, it transmits abnormality generation information to the monitor 33 in the cab 12 of the hydraulic excavator to display the same, thus informing the operator thereof. Further, it transmits the abnormality generation information via the communication device 34 to the portable terminal 35 held by the maintenance technician to display the same, thus informing the maintenance technician thereof.

As described above, in the present embodiment, there is computed the command continuation time in the state in which the command output to the pump capacity switching device 36 is not changed, and in the case where the command continuation time is a predetermined value or more, it is determined that the pump capacity switching device 36 is abnormal. As a result, it is possible to detect abnormality in the pump capacity switching device independently of the abnormality state of the pump capacity switching device 36 (in particular, the state in which it is fixed to pump large capacity or the state in which it is fixed to the pump medium capacity).

Figure 16:
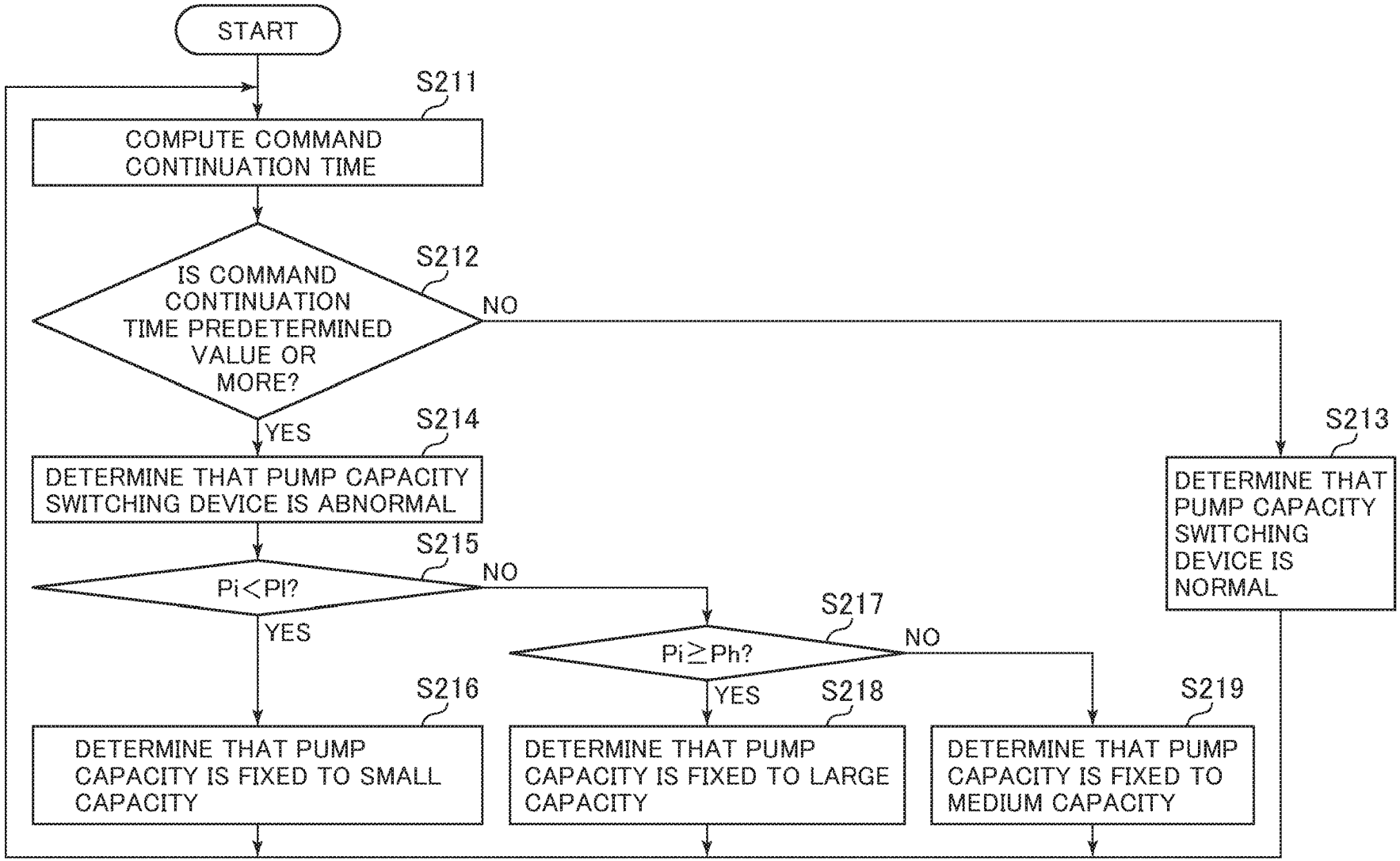
FIG. 16 is a flowchart illustrating the processing of an abnormality determination section of the controller according to a second modification of the present invention.

Although not described in particular, in the second embodiment, in the case where it is determined that the pump capacity switching device 36 is abnormal, the abnormality determination section 32A of the controller 30A may distinguish the abnormality state in accordance with the pressure value Pi of the pressure sensor 29. Such a modification will be described with reference to FIG. 16. FIG. 16 is a flowchart illustrating the processing of the abnormality determination section 32A of the controller 30A of the present modification.

Steps S211 to S214 are the same as those of the second embodiment. In step S214, the abnormality determination section 32A determines that the pump capacity switching device 36 is abnormal, and then the procedure advances to step S215.

In step S215, the abnormality determination section 32A determines whether or not the pressure value Pi of the pressure sensor 29 is less than the lower limit value Pl. In the case where the pressure value Pi is less than the lower limit value Pl, the procedure advances to step S216, where it identifies the abnormality state in which the pump capacity is fixed to small capacity. In the case where the pressure value Pi is the lower limit value Pl or more, the procedure advances to step S217, where it determines whether or not the pressure value Pi of the pressure sensor 29 is the upper limit value Ph or more. In the case where the pressure value Pi is the upper limit value Ph or more, the procedure advances to step S218, where it identifies the abnormality state in which the pump capacity is fixed to large capacity. In the case where the pressure value Pi is less than the upper limit value Ph, the procedure advances to step S219, where it identifies the abnormality state in which the pump capacity is fixed to medium capacity.

Then, the abnormality determination section 32 of the controller 30 transmits the abnormality generation information and the abnormality state information of the pump capacity switching device 36 to the monitor 33 and the portable terminal 35 to display the same. This helps to cope with the abnormality in the pump capacity switching device 36.

Regarding the first embodiment, there has been described the case where the unloading valve 27 is provided as the pump output power switching device, and regarding the second embodiment, there has been described the case where the pump capacity switching device 36 is provided as the pump output power switching device. This, however, should not be construed restrictively. Modifications are possible without departing from the scope of the gist and technical idea of the present invention. For example, it is also possible to provide both the unloading valve 27 and the pump capacity switching device 36. Alternatively, the pilot pump 17 may be driven by an electric motor, and there may be provided an inverter selectively switching the pilot pump 17 between high rotation and low rotation previously set. In these cases also, it is possible to attain the same result as described above.

The third embodiment of the present invention will be described with reference to FIGS. 17 through 20. In the present embodiment, the components that are the same as or equivalent to those of the first embodiment are indicated by the same reference numerals, and a description thereof will be left out as appropriate.

Figure 17:
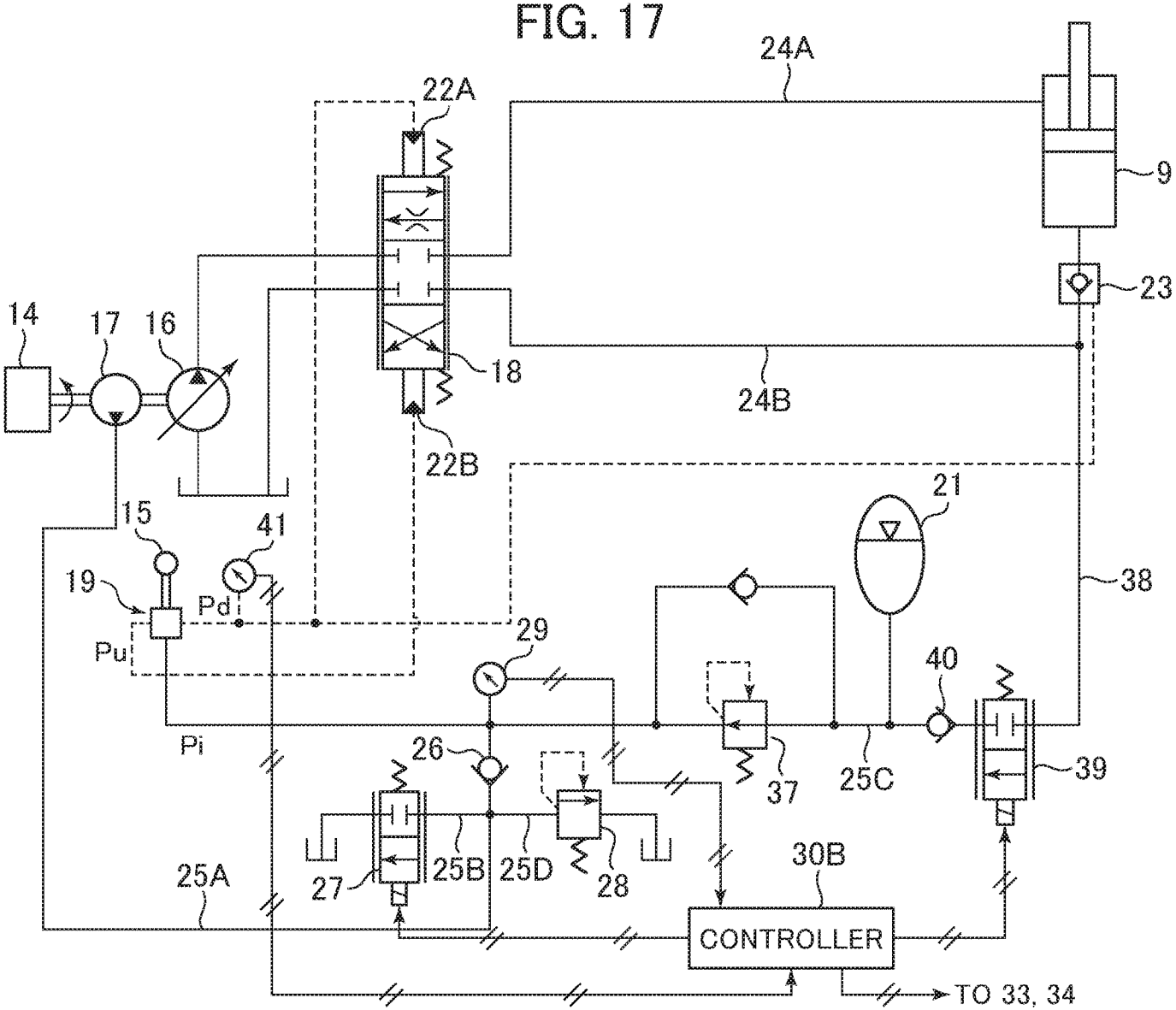
FIG. 17 is a diagram illustrating, of the structure of a hydraulic control system of the hydraulic excavator according to a third embodiment of the present invention, the structure of a main circuit and a pilot circuit related to the driving of the boom cylinder.
Figure 18:
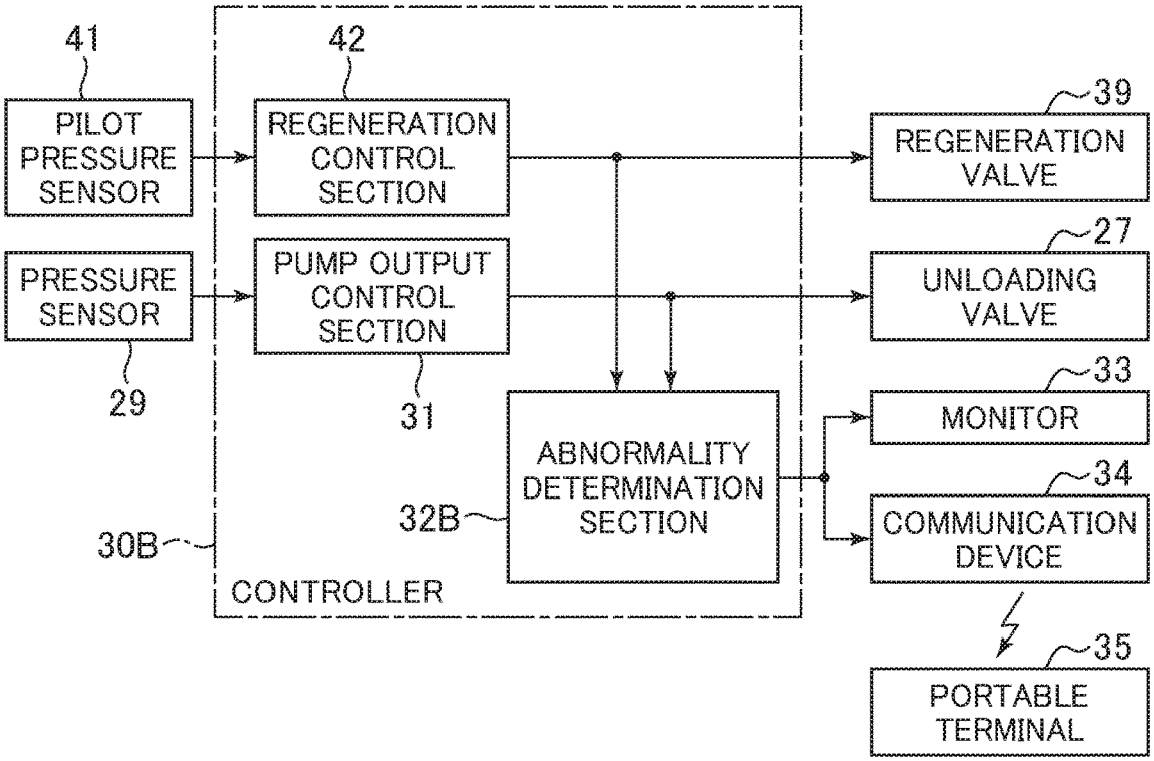
FIG. 18 is a block diagram illustrating the functional structure of a controller according to the third embodiment of the present invention along with related apparatuses.

FIG. 17 is a diagram illustrating, of the structure of a hydraulic control system of the hydraulic excavator according to the present embodiment, the structure of a main circuit and a pilot circuit related to the driving of the boom cylinder 9. FIG. 18 is a block diagram illustrating the functional structure of a controller according to the present embodiment along with related apparatuses.

The hydraulic control system of the present embodiment is equipped with the hydraulic line 25A connecting the delivery side of the pilot pump 17 and the pilot valves 20 of the operation device 19, the pump check valve 26 provided in the hydraulic line 25A, the unloading valve 27 connected to the pilot pump 17 side of the hydraulic line 25A with respect to the pump check valve 26 via the hydraulic line 25B, the accumulator 21 connected to the pilot valve 20 side of the hydraulic line 25A with respect to the pump check valve 26 via the hydraulic line 25C, a pressure reducing valve 37 with a check valve provided in the hydraulic line 25C, a relief valve 28 connected to the pilot pump 17 side of the hydraulic line 25A with respect to the pump check valve 26 via a hydraulic line 25D, the pressure sensor 29 provided on the pilot valve 20 side of the hydraulic line 25A with respect to the pump check valve 26, and a controller 30B.

In the case where the pressure on the accumulator 21 side is higher than the pressure on the hydraulic line 25A side (more specifically, the downstream side of the pump check valve 26), the pressure reducing valve 37 with check valve reduces the pressure of the hydraulic fluid from the accumulator 21 and supplies it to the hydraulic line 25A (that is, the pilot valves 20). On the other hand, in the case where the pressure on the hydraulic line 25A side (more specifically, the downstream side of the pump check valve 26) is higher than the pressure on the accumulator 21 side, the hydraulic fluid from the hydraulic line 25A (that is, the pilot pump 17) is supplied to the accumulator 21.

The hydraulic control system of the present embodiment is further equipped with a recovery line 38 branch-connected from between the control valve 18 and the check valve 23 of the line 24B and join-connected to the hydraulic line 25C, a regeneration valve 39 (solenoid switching valve) provided in the recovery line 38 and selectively switched between the interruption position and the communication position, a regeneration check valve 40 provided between the regeneration valve 39 and the accumulator 21, and a pilot pressure sensor 41.

The recovery line 38 serves to supply to the accumulator 21 the return fluid from the bottom side fluid chamber of the boom cylinder 9 when the boom cylinder 9 contracts. The regeneration check valve 40 permits the flow of the hydraulic fluid from the regeneration valve 39 to the accumulator 21, and prevents the flow of the hydraulic fluid from the accumulator 21 to the regeneration valve 39. The pilot pressure sensor 41 detects the pilot pressure Pd output from the pilot valve 20 of the operation device 19 to the pressure receiving section 22A of the control valve 18, and outputs it to the controller 30B.

The controller 30B has, as the functional components, a regeneration control section 42, a pump output power control section 31, and an abnormality determination section 32B. As in the first embodiment, the pump output power control section 31 controls the unloading valve 27 in accordance with the pressure Pi detected by the pressure sensor 29.

Figure 19:
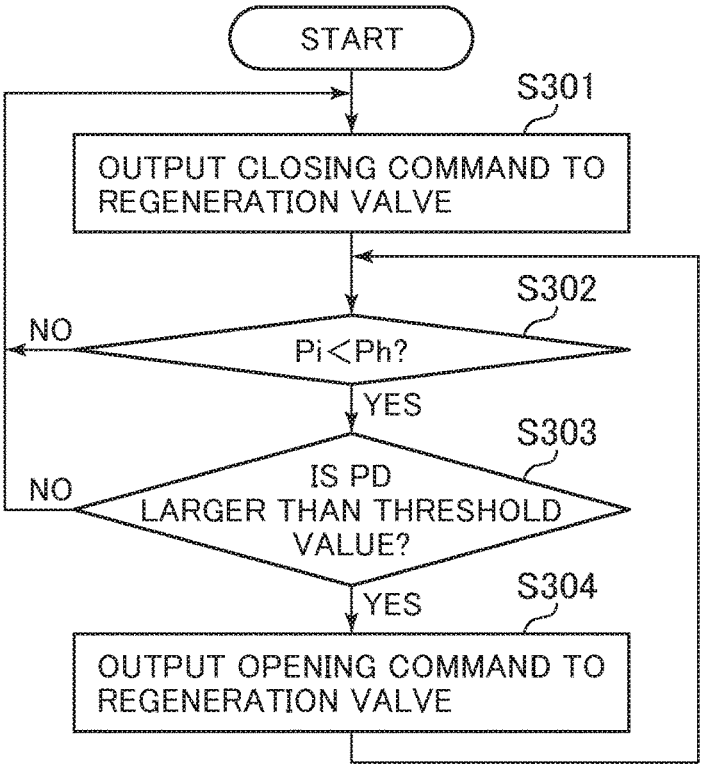
FIG. 19 is a flowchart illustrating the processing of a regeneration control section of the controller of the third embodiment of the present invention.

The regeneration control section 42 of the controller 30B controls the regeneration valve 39 in accordance with the pressure Pi detected by the pressure sensor 29 and the pilot pressure Pd detected by the pilot pressure sensor 41. This will be described in detail with reference to FIG. 19. FIG. 19 is a flowchart illustrating the processing of the regeneration control section 42 of the controller 30B according to the present embodiment.

In step S301, the regeneration control section 42 outputs a closing command to the regeneration valve 39 (more specifically, outputs no drive signal), and places the regeneration valve 39 at the interruption position. The procedure advances to step S302, where the regeneration control section 42 determines whether or not the pressure value Pi of the pressure sensor 29 is less than the upper limit value Ph. In the case where the pressure value Pi is the upper limit value Ph or more, the procedure returns to step S301, and procedures similar to those described above are repeated. On the other hand, in the case where the pressure value Pi is less than the upper limit value Ph, the procedure advances to step S303.

In step S303, the regeneration control section 42 determines whether or not the pressure value Pd of the pilot pressure sensor 41 exceeds a previously set threshold value. In the case where the pressure value Pd is less than the threshold value, the procedure returns to step S301, and procedures similar to those described above are repeated. On the other hand, in the case where the pressure value Pd exceeds the threshold value, the procedure advances to step S304.

In step S304, the regeneration control section 42 outputs an opening command to the regeneration valve 39 (more specifically, outputs a drive signal), and places the regeneration valve 39 at the communication position. As a result, the return fluid from the bottom side fluid chamber of the boom cylinder 9 is supplied to the accumulator 21.

Figure 20:
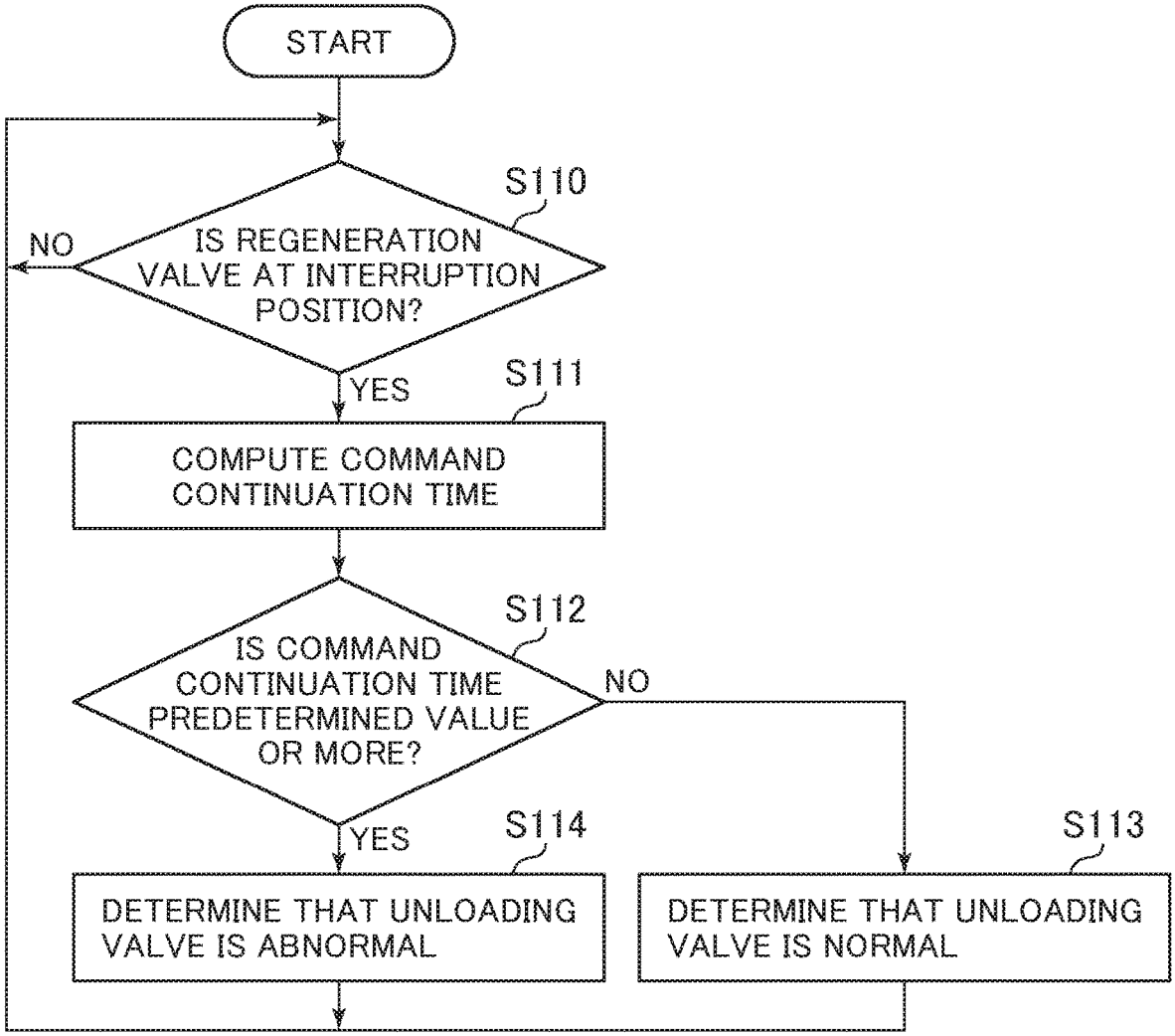
FIG. 20 is a flowchart illustrating the processing of an abnormality determination section of the controller of the third embodiment of the present invention.

In the case where the regeneration valve 39 is at the interruption position, the abnormality determination section 32B of the controller 30B, which is the main section of the present embodiment, computes a command continuation time in the state in which the command output from the pump output power control section 31 to the unloading valve 27 is not changed, and, based on this command continuation time, determines whether or not the unloading valve 27 is abnormal, outputting the determination result. This will be described in detail with reference to FIG. 20. FIG. 20 is a flowchart illustrating the processing of the abnormality determination section 32B of the controller 30B according to the present embodiment.

Steps S111 through S114 are the same as those of the first embodiment. In step S110, which precedes these steps, the abnormality determination section 32B determines whether or not the closing command has been output from the regeneration control section 42 to the regeneration valve 39, whereby it is determined whether or not the regeneration valve 39 is at the interruption position. In the case where it determines that the regeneration valve 39 is not at the interruption position, step S110 is repeated. On the other hand, in the case where it determines that the regeneration valve 39 is at the interruption position, the procedure advances to step S111.

As in the first embodiment, also in the present embodiment constructed as described above, it is possible to detect abnormality in the unloading valve 27 independently of the abnormality state of the unloading valve 27.

Although not described in particular, in the third embodiment, in the case where it is determined that the unloading valve 27 is abnormal, the abnormality determination section 32B of the controller 30B may distinguish the abnormality state in accordance with the pressure Pi detected by the pressure sensor 29 (See FIG. 11 referred to above).

Further, while in the third embodiment described above the unloading valve 27 is provided as the pump output power switching device, this should not be construed restrictively. Modifications are possible without departing the scope of the gist and technical idea of the present invention. As in the second embodiment, the pump capacity switching device 36 may be provided, or both the unloading valve 27 and the pump capacity switching device 36 may be provided. Alternatively, the pilot pump 17 may be driven by an electric motor, and there may be provided an inverter selectively switching the pilot pump 17 between high rotation and low rotation. Also in these cases, it is possible to attain the same results as described above.

While in the example described above the present invention is applied to the hydraulic control system of the hydraulic excavator which is provided with the accumulator 21 connected to a hydraulic line between the manual operation type pilot valve 20 (hydraulic apparatus) and the pilot pump (hydraulic pump), this should not be construed restrictively. For example, the present invention may also be applied to a structure including a sensor detecting the operation amount of an operation member, an operation control section of a controller generating a drive signal corresponding to the operation amount of the operation member detected by the sensor and outputting the same, an electric operation type pilot valve (solenoid proportional valve) driven by the drive signal from the operation control section of the controller, and an accumulator connected to a hydraulic line between the pilot valve and a pilot pump. Further, the present invention may be applied to a structure equipped with an accumulator connected between some other hydraulic apparatus than a pilot valve and a hydraulic pump, or the present invention may be applied to the hydraulic control system of a work machine other than the hydraulic excavator.

DESCRIPTION OF REFERENCE CHARACTERS

9: Boom cylinder
12: Cab
15: Work operation member
16: Main pump
17, 17A: Pilot pump
18: Control valve
19: Operation device
20: Pilot valve
21: Accumulator
26: Pump check valve
27: Unloading valve
29: Pressure sensor
30, 30A, 30B: Controller
31, 31A: Pump output power control section
32, 32A: Abnormality determination section
33: Monitor
34: Communication device
35: Portable terminal
36: Pump capacity switching device
38: Recovery line
39: Regeneration valve
40: Regeneration check valve
41: Pilot pressure sensor
42: Regeneration control section

The invention claimed is:

1. A work machine hydraulic control system comprising:
a hydraulic pump;
a hydraulic apparatus connected to a delivery side of the hydraulic pump;
a pump output power switching device selectively switching the hydraulic pump between a high output power and a low output power;
an accumulator connected to a hydraulic line between the hydraulic pump and the hydraulic apparatus, accumulating a portion of a hydraulic fluid delivered from the hydraulic pump when the hydraulic pump is of high output power, and supplying the hydraulic fluid to the hydraulic apparatus when the hydraulic pump is of low output power;
a pump check valve permitting flow of the hydraulic fluid from the hydraulic pump to the hydraulic apparatus and the accumulator and preventing flow of the hydraulic fluid from the accumulator to the hydraulic pump;
a pressure sensor detecting a pressure of the hydraulic fluid supplied to the hydraulic apparatus from one of the hydraulic pump and the accumulator; and
a controller having a pump output power control section that in a case where pressure value of the pressure sensor is equal to or more than a previously set upper limit value when the hydraulic pump is of high output power, outputs a low output power command to the pump output power switching device in order to switch the hydraulic pump to low output power, and that in a case where the pressure value of the pressure sensor is equal to or less than a previously set lower limit value when the hydraulic pump is of low output power, outputs a high output power command to the pump output power switching device in order to switch the hydraulic pump to high output power, wherein
the controller further comprises an abnormality determination section that computes a command continuation time in a state in which the command output from the pump output power control section to the pump output power switching device is not changed, and that in a case where the command continuation time is equal to or more than a previously set predetermined value, determines that there is abnormality in the pump output power switching device, and outputs a determination result.

2. The work machine hydraulic control system according to claim 1, wherein in a case where it is determined that the pump output power switching device is abnormal, the abnormality determination section of the controller distinguishes an abnormality state in accordance with the pressure value of the pressure sensor, and outputs a distinguishing result.

3. The work machine hydraulic control system according to claim 1, wherein the pump output power switching device is an unloading valve connected to a hydraulic line between the hydraulic pump and the pump check valve and selectively switched between an interruption position and a communication position; and
when the high output power command is output from the pump output power control section, the unloading valve is switched to the interruption position to supply the hydraulic fluid delivered from the hydraulic pump to the hydraulic apparatus and the accumulator, and when the low output power command is output from the pump output power control section, the unloading valve is switched to the communication position to cause the hydraulic fluid delivered from the hydraulic pump to flow via the unloading valve.

4. The work machine hydraulic control system according to claim 1, wherein the hydraulic pump is of a variable displacement type; and
the pump output power switching device is a pump capacity switching device selectively switching the hydraulic pump between large capacity where it is of high output power and small capacity where it is of low output power.

5. The work machine hydraulic control system according to claim 1, wherein the abnormality determination section of the controller transmits abnormality generation information to a monitor in a cab of a work machine to display the information.

6. The work machine hydraulic control system according to claim 1, wherein the abnormality determination section of the controller transmits abnormality generation information to a portable terminal via a communication device to display the information.

7. The work machine hydraulic control system according to claim 1, further comprising:
a main pump;
a hydraulic actuator driven by the hydraulic fluid delivered from the main pump; and
a control valve controlling the flow of the hydraulic fluid from the main pump to the hydraulic actuator, wherein
the hydraulic apparatus is a pilot valve that, using the pressure of the hydraulic fluid supplied from one of the hydraulic pump and the accumulator as an original pressure, generates a pilot pressure corresponding to operation amount of an operation member, and that operates the control valve by the pilot pressure.

8. The work machine hydraulic control system according to claim 7, further comprising:
a recovery line for supplying return fluid from the hydraulic actuator to the accumulator;
a regeneration valve provided in the recovery line and selectively switched between an interruption position and a communication position;

a regeneration check valve permitting flow of the hydraulic fluid from the regeneration valve to the accumulator and preventing flow of the hydraulic fluid from the accumulator to the regeneration valve; and a pilot pressure sensor detecting the pilot pressure output from the pilot valve to the control valve, wherein the controller further has a regeneration control section selectively switching the regeneration valve between an interruption position and a communication position in accordance with the pressure detected by the pressure sensor and the pilot pressure detected by the pilot pressure sensor, and in a case where the regeneration valve is at the interruption position, the abnormality determination section of the controller computes a command continuation time in a state in which a command output from the pump output power control section to the pump output power switching device is not changed, and in a case where the command continuation time is a previously set predetermined value or more, determines that the pump output power switching device is abnormal, and outputs the determination result.

* * * * *